US006280341B1

(12) United States Patent
Hayashi

(10) Patent No.: US 6,280,341 B1
(45) **Date of Patent: *Aug. 28, 2001**

(54) ESTABLISHMENT FOR VIEWING IMAGE

(76) Inventor: Masahiko Hayashi, 12-22, Tsurumaki, 3-chome, Setagaya-ku, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/203,209

(22) Filed: Nov. 30, 1998

(51) Int. Cl.[7] ..... A63G 31/00
(52) U.S. Cl. ..... 472/61; 472/130; 434/55
(58) Field of Search ..... 472/59, 60, 61, 472/130; 434/55; 52/6, 8, 9

(56) References Cited

U.S. PATENT DOCUMENTS

| | | | | |
|---|---|---|---|---|
| 3,468,533 | * | 9/1969 | House, Jr. | 472/60 |
| 3,602,499 | * | 8/1971 | Kojima | 472/60 |
| 3,758,714 | * | 9/1973 | Herndon | 472/60 |
| 5,499,920 | * | 3/1996 | Trumbull | 472/60 X |

* cited by examiner

*Primary Examiner*—Kien T. Nguyen
(74) *Attorney, Agent, or Firm*—Jordan and Hamburg LLP

(57) ABSTRACT

The present invention provide an establishment for viewing an image that the Spectators can see the image projected on the sceen from the seat while they move so that the spectators can experience a big change for visual sense, various visual experience as well as a non-daily-physical sense.

9 Claims, 25 Drawing Sheets

ESTABLISHMENT FOR VIEWING IMAGE

BACKGROUND OF THE INVENTION

The present invention is related to an establishment for viewing image which is used as a recreation facility of an amusement park, an observation restaurant or the like.

The conventional recreation faclihty of the amusement park makes a seat for guest move while it rotates and allows the audience or spectators experience a non-daily-vision and a gravitational feeing, however, a non-daily-sense of vision not be produced vision since a visual object was usually qualified on real scenery of a circumferential portion of a seat for guest.

The object of non-daily is emphasized a physical sense such as a gravitational feeling, a speed feeling or the like than vision. Today, the movement of a seat for guest is more rapid and violent the possibility of danger is enlarging with regard to movement of the seat.

SUMMARY OF THE INVENTION

In view of the foregoing, it is an object of the present invention to provided an establishment for viewing an image by which the spectators can experience a big change for visual sense as well as a non-daily- physical sense by movement of a seat for the guest. Also, it is another object of the present invention to provide an establishment for viewing an image which can be used as an establishment that they do not tire of by providing the spectators with various visual experience.

The novel featurewhich are believed to be characteristic of the invention, both as to its organization and method of operation, together with further projects and advantages thereof will be better understood from the following description considered in connection with accompanying drawings in which a presently preferred embodiment of the invention is illustrated by way of example. It is to be expressly understood, however, that the drawings are for the purpose of illustration and description only, and are not intended as a definition of the limits of the invention.

DETAILED DESCRIPTION OF THE INVENTION

Figure 1:
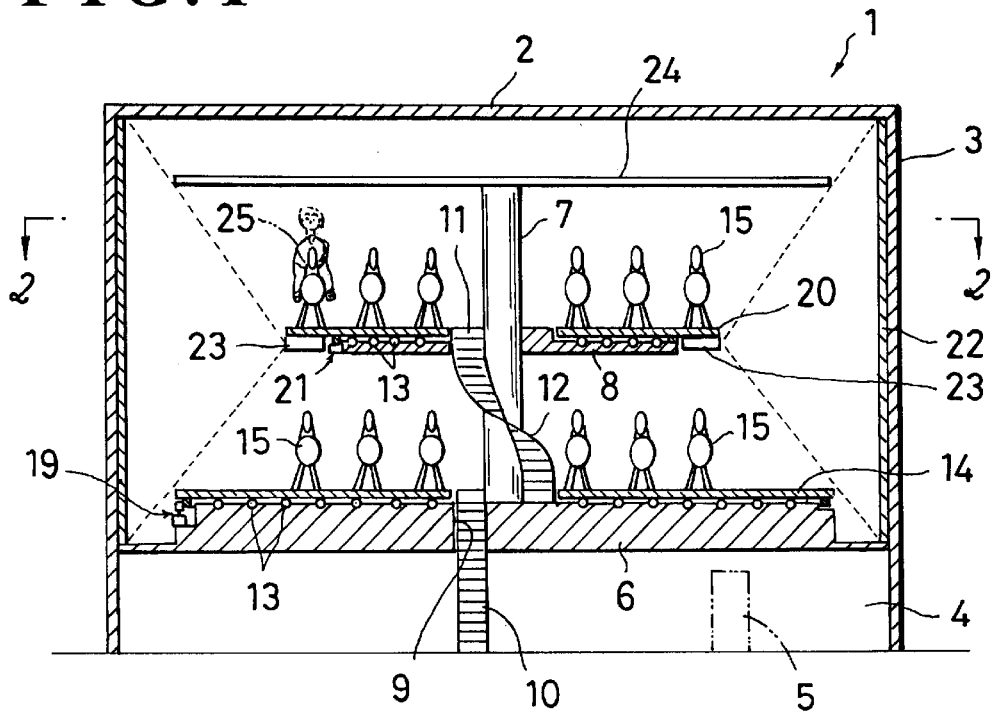
FIG. 1 is a vertical cross-sectional view showing a first embodiment of the present invention.
Figure 2:
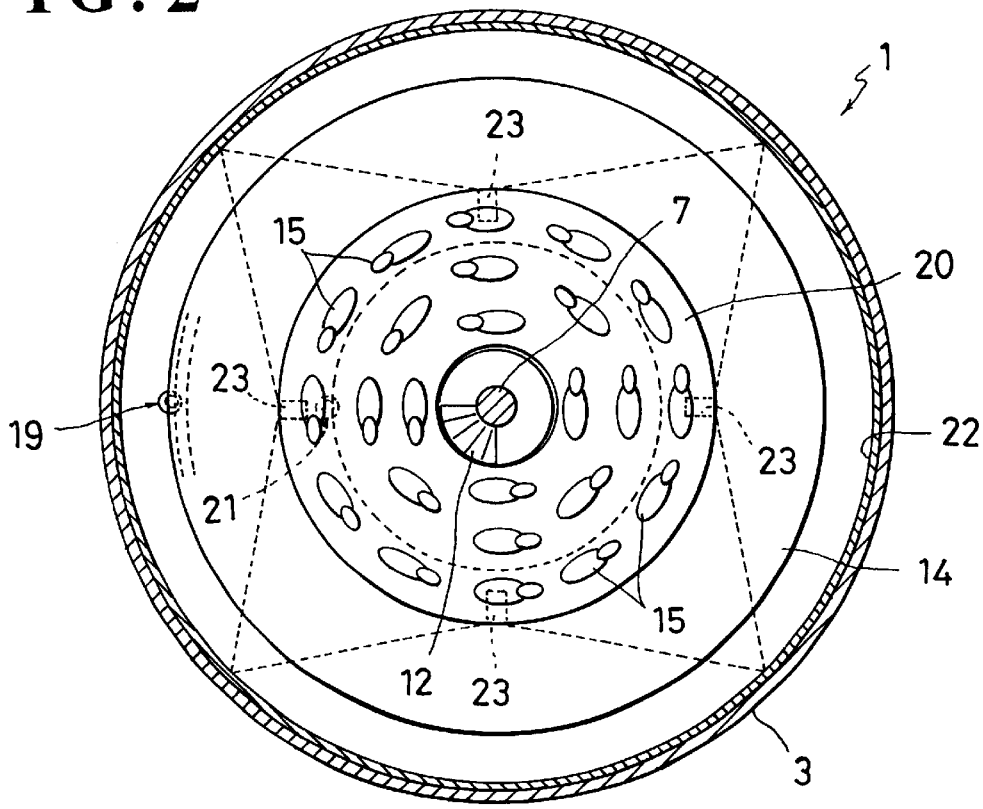
FIG. 2 is a crss-sectional view taken on line 2—2 of FIG. 1.
Figure 3:
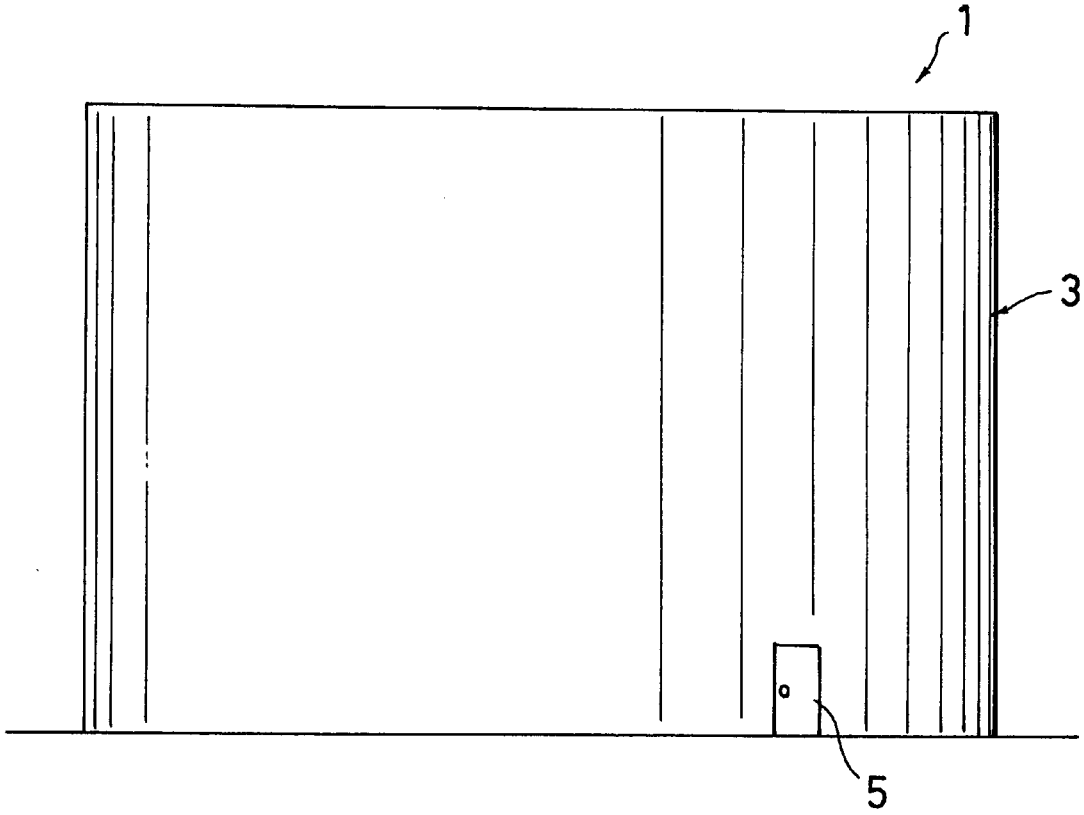
FIG. 3 is a front view showing a frst embodiment of the present invention.
Figure 4:
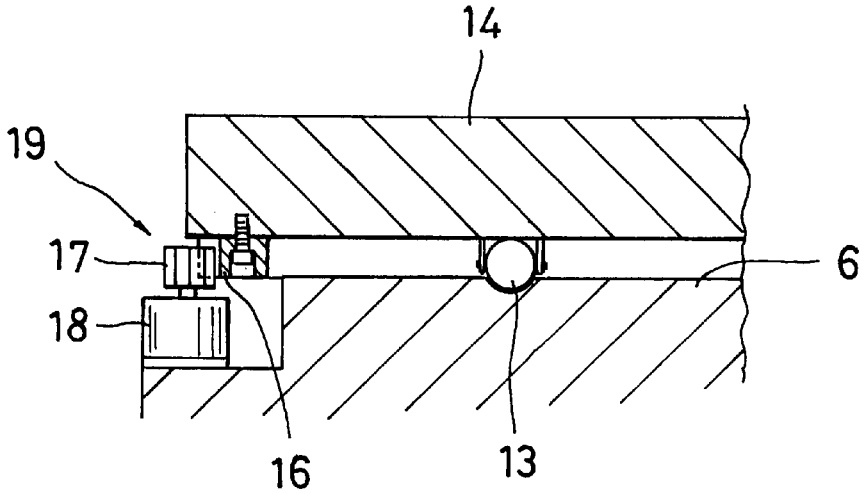
FIG. 4 is an explanation view of a move device showing a first embodiment of the present invention.

Preferred embodiment of the present invention are described m more detail below referring to the accompanying drawing;

An understanding of the present invention may be best gained by reference to FIGS. 1 to 4. FIGS. 1 to 4 illustrate an establishment for viewing an image of the first embodiment of the present invention. Numeral 1 is an establishment for viewing an image which is used as a recreation facility of the amusement park and is composed of a building 3 with two stories, a door 5, a floor surface 6 for a second floor, a support 7, a floor surface 8 for a mezzanine, a stair 10, a spiral staircase 12, a moving object 14, a plurality of wooden horses 15, a move device 19, a moving object 20 for the mezzanine, the wooden horses 15 mounted to the moving object 20, a move device 21 for the mezzanine, a screen 22, four pieces ofprojectors 23, 23, 23, 23, and a ceiling board 24.

The two-storied building 3 has a ceiling 2 at an upper surface thereof The door 5 is provided on a wall surface of a first floor used as a waiting room of the building 3. The floor surface 6 for the second floor projects upwardly excepting the circumferential portion thereof in the building 3. The support 7 is provided vertically substantially at the central portion of the floor surface 6. The floor surface 8 for the mezzanine is fixed at the central portion of the support 7, the floor surface 8 forming at the mezzanine. The stair 10 is provided in order to connect with the waiting room 4 and an entrance 9 located at the central portion of the floor surface 6. The spiral stair case 12 is provided in a circumferential portion of the support 7 for connecting with the floor surface 6 and an entrance 11 located at a central portion of the floor surface 8 for the mezzanine. The moving object 14 is attached rotatably on the floor surface 6 for the second floor through a plurality of rollers 13. The wooden horses 15 as a seat for guest are attached fixedly to the moving object 14. The move device 19 is further composed of a gear 16 in the shape of a ring and a motor 18: the gear 16 allows the moving object 14 to move as it rotates, the gear 16 being fixed to the outer ciruerential portion of the moving object 14; and the motor 18 is fixed to the floor surface 6, the motor 18 having a pinion 17 meshing with the gear 16. The moving object 20 for the mezzanine in the shape of a disc is fixed rotatably on the floor surface 8 for the mezzanine through the rollers 13. The plurality of wooden horses 15 each as a seat for guest is provided fixedly to the moving objects 20 for the mezzanine. The move device 21 for the mezzaine is further composed of a gear 16 in the shape of a ring and a motor 18: the gear 16 allows the moving object 14 to move as it rotates, the gear 16 being fixed to the outer circumferential portion of the moving object 14; and the motor 18 is fixed to the floor surface 6, the motor 18 having a pinion 17 meshing with the gear 16. The screen 22 in the shape of a cylinder is provided to an inner wall surface of the second floor portion of the building 3. The projectors 23 which comprise an image producing system are provided adjacent outside the floor surface 8, the projectors 23 being capable of projecting the continuous panoraimc image without joining portions on the screen 2. The ceiling board 24 is fixed at an upper portion of the support 7, the ceiling board 24 giving a depth to the image projected at upper portion on the screen 2 in the shape of a cylinder.

In the establishment for viewing image 1 of the above-mentioned structure, the spectators 25 mount the wooden horses 15 and they view the image projected on the screen 22 in the shape of a cylinder, however, the moving objects 14 and 20 provided the wooden horses 15 as a seat for guest thereon are rotated by the move devices 19 and 21, and the continuous panoramic image having no jointing portions projected on the screen 22 in the shape of a cylinder so that the spectators 25 can experience not only physical sense with non-daily life but also pronounced visual change.

Other embodiments of the present invention will now be described referring to FIGS. 5 to 49. Through the drawings of the embodiments, like components are denoted by like numerals as of the first embodiment and will not be further expained.

Figure 5:
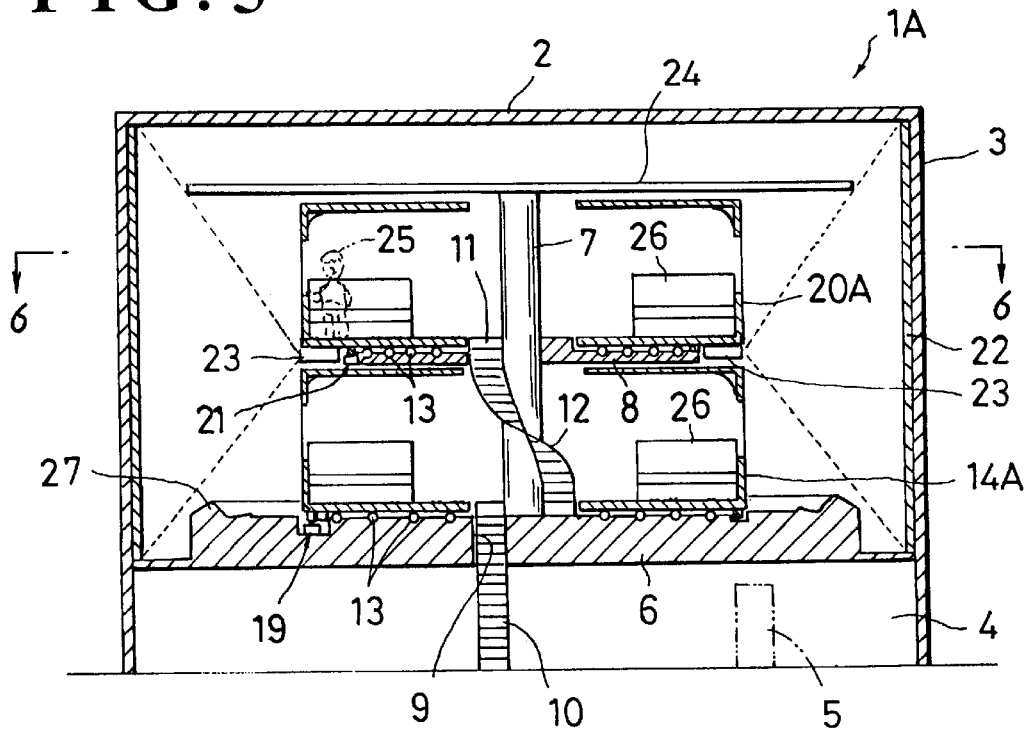
FIG. 5 is a vertical cross-sectional view showing a second embodiment of the present invention.
Figure 6:
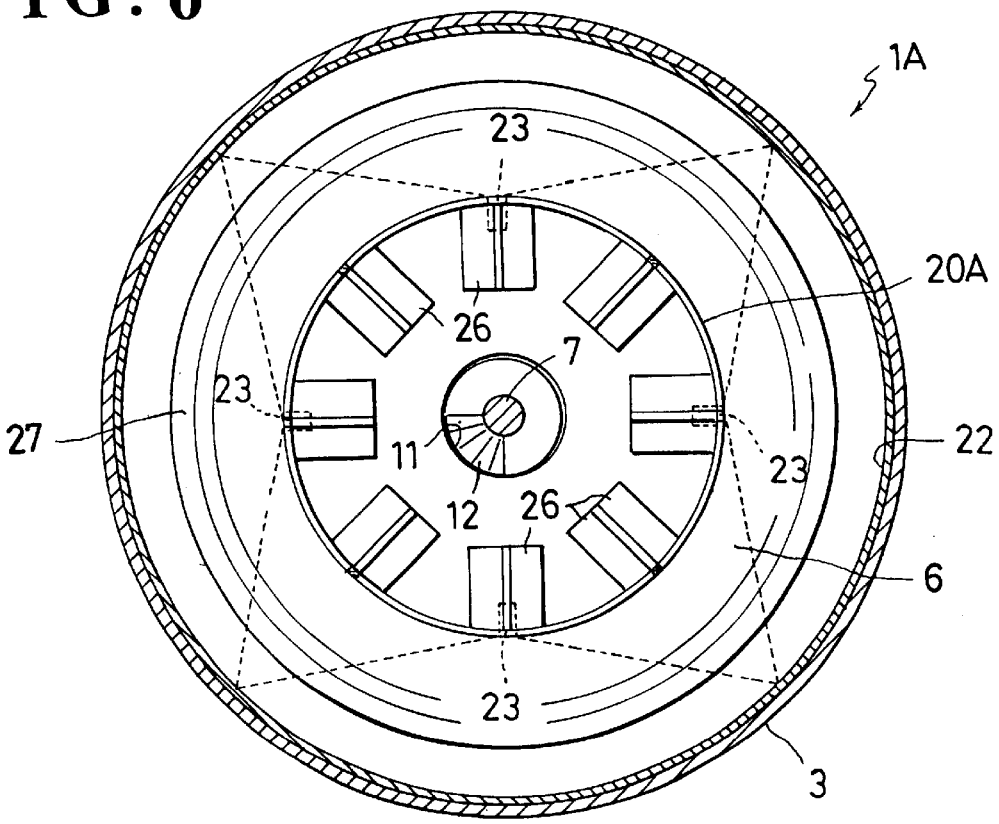
FIG. 6 is a cross-sectional view taken on line 6—6 of FIG. 5.

A second embodiment of the present invention is shown in FIGS. 5 and 6. It is distinguished from the first embodiment by the fact that a moving object 14A in the shape of a cylinder indudes seats 26 which face each other respectively similar to a passenger cabin of the train, a moving object 20 for the mezzanine in the shape of the same as the moving object 14A, and a shoulder 27 of a rail is provided at an outer circumferential portion of the floor surface 6 of the second floor. Accordingly, an establishment for viewing image 1A of the second embodiment can produce a realistic effect.

Furthermore, the seats 26, 26 of the moving objects 14A and 20A may be located forwardly or horizontally, and the seats 26, 26 may be formed like a box seat.

Figure 7:
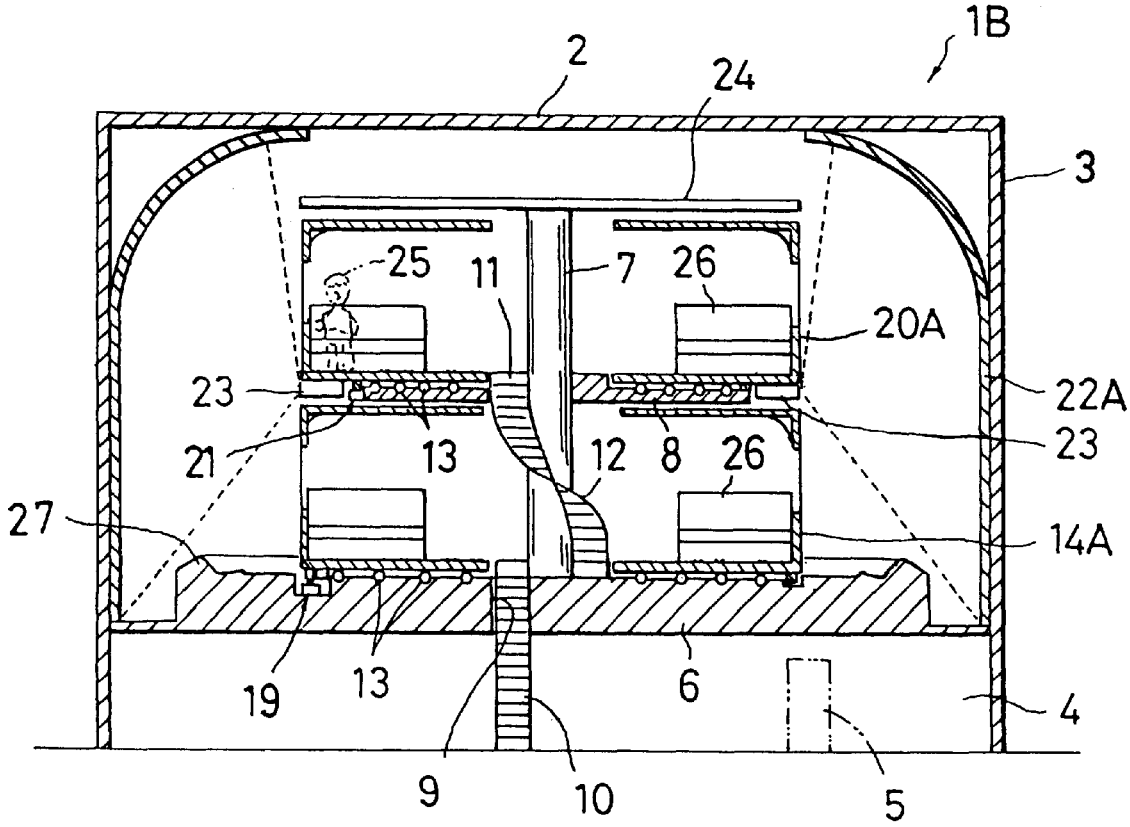
FIG. 7 is a vertical cross-sectonal view showing a third embodiment of the present invention.

A third embodiment of the present invention is shown in FIG. 7. It is distinguished from the second embodiment by the fact that a tubular screen 22A, is used an upper portion of which is a concave. Accordingly, an establishment for viewing image 1B of the third embodiment can dire the upper portion of the image for the spectator as natural scenery.

Figure 8:
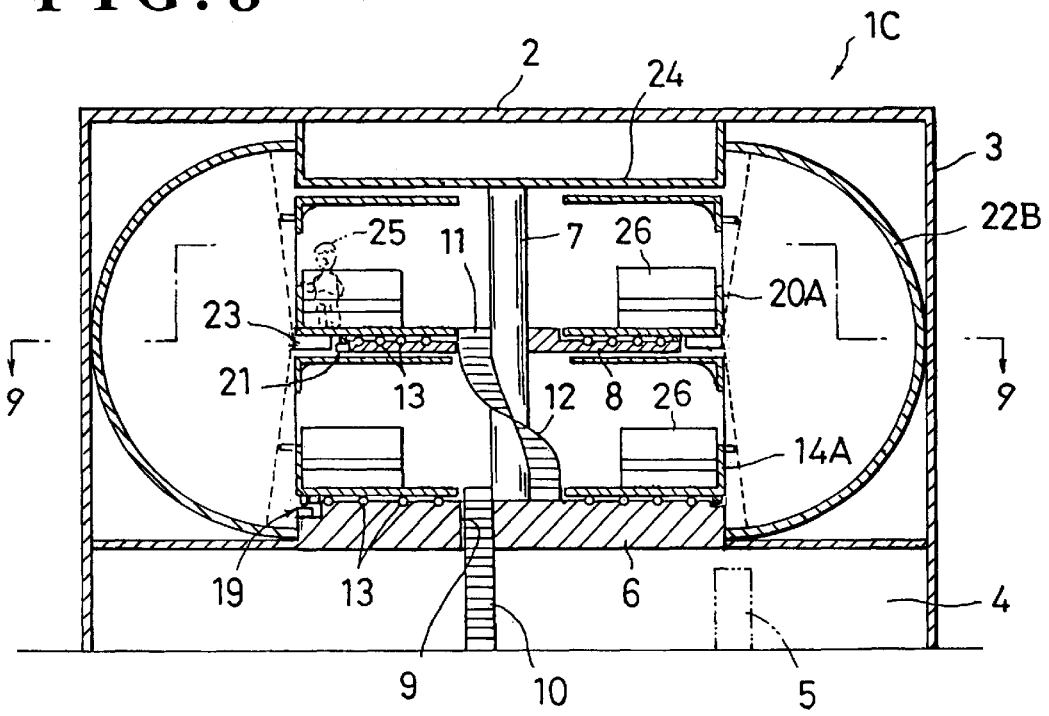
FIG. 8 is a vertical cross-sectional view showing a fourth embodiment of the present invention.
Figure 9:
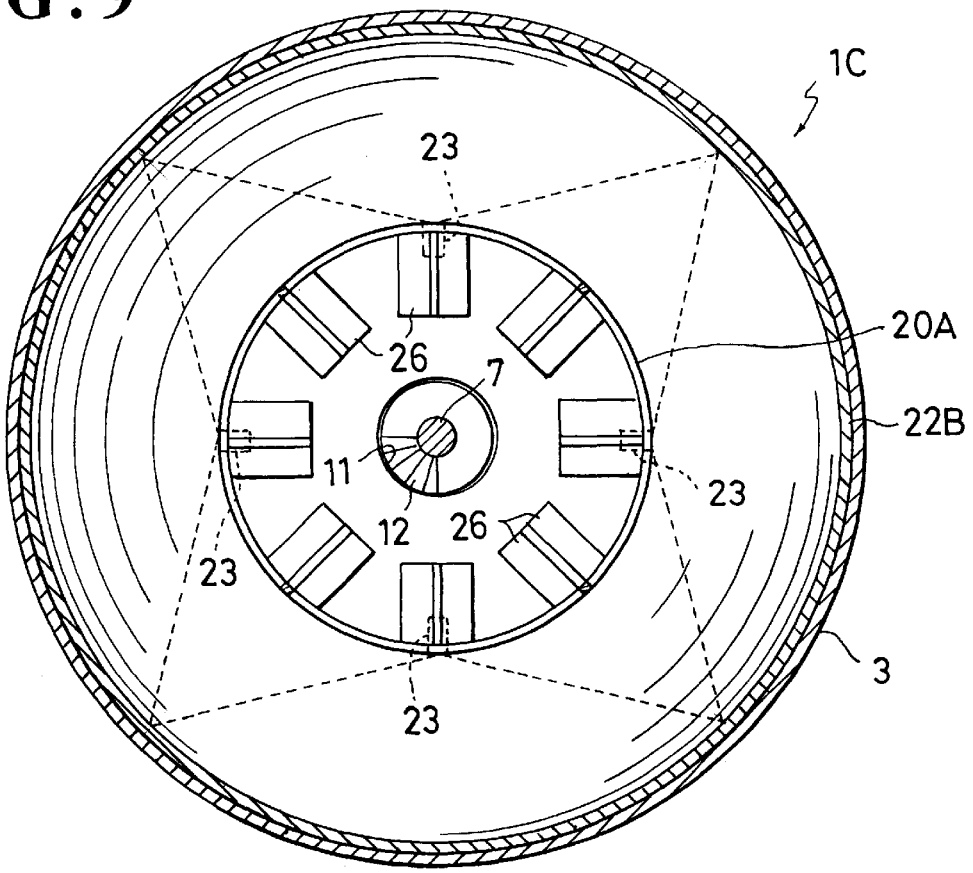
FIG. 9 is a cross-sectional view taken on line 9—9 of FIG. 8.

A fourth embodiment of the present invention is shown in FIGS. 8 and 9. It is distinguished from the second embodiment by the fact that a tubular screen 22B is formed in the shape of a semicircle. Accordingly, an establishment for viewing image 1C of the fourth embodiment can direct freely the image for the spectator as a scenery viewed through the window.

Figure 10:
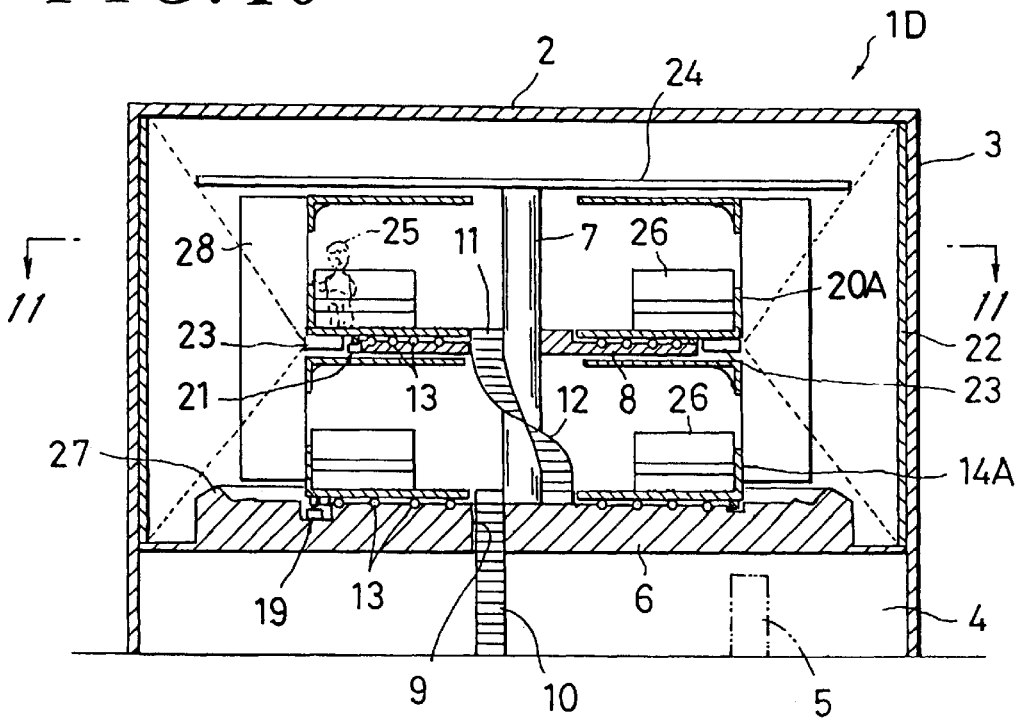
FIG. 10 is a vertical cross-sectional view showing a fifth embodiment of the present invention.
Figure 11:
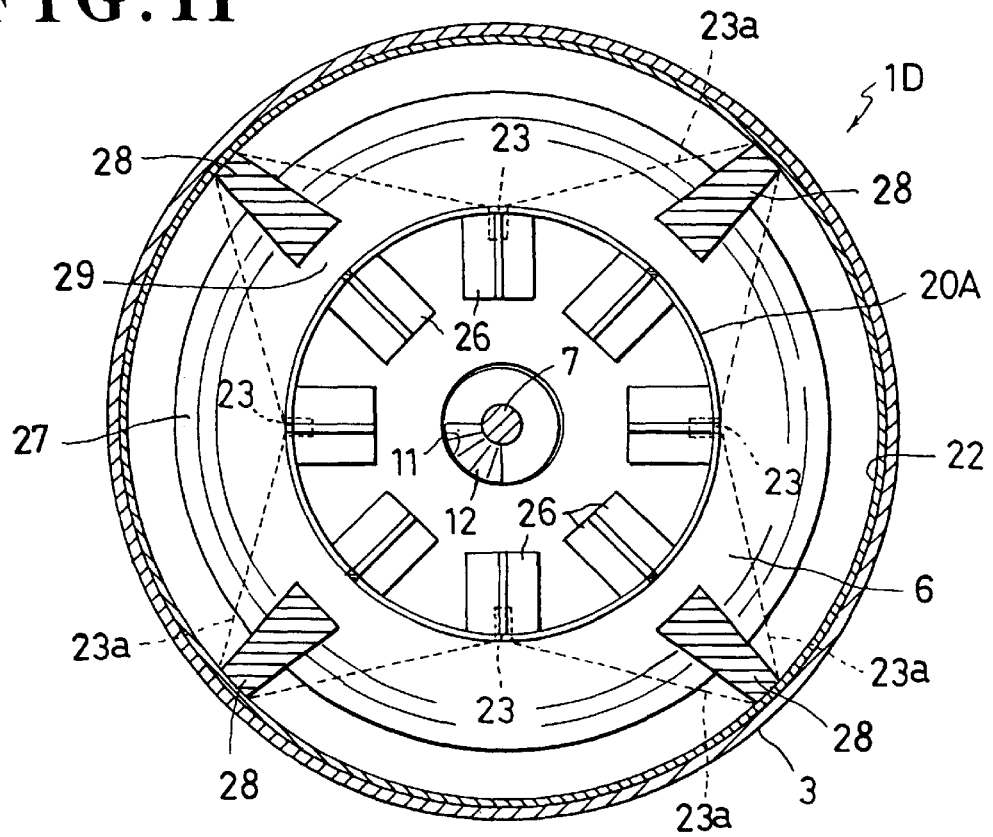
FIG. 11 is a cross-sectional view taken online 11—11 of FIG. 10.

A fifth embodiment of the present invention is shown in FIGS. 10 and 11. It is distinguished from the second embodiment by the fact that images 23*a*, 23*a*, 23*a*, 23*a* of the projectors 23, 23, 23, 23 are partitioned by partition walls 28, 28, 28, 28. Acoordingly, an establishment for viewing image 1D of the fiftih embodiment can direct as other image scenery when the spectators 25 in the moving objects 14 and 20 passes through tunnel portions 29, 29, 29, 29 provided at a front space of the partition walls 28.

Figure 12:
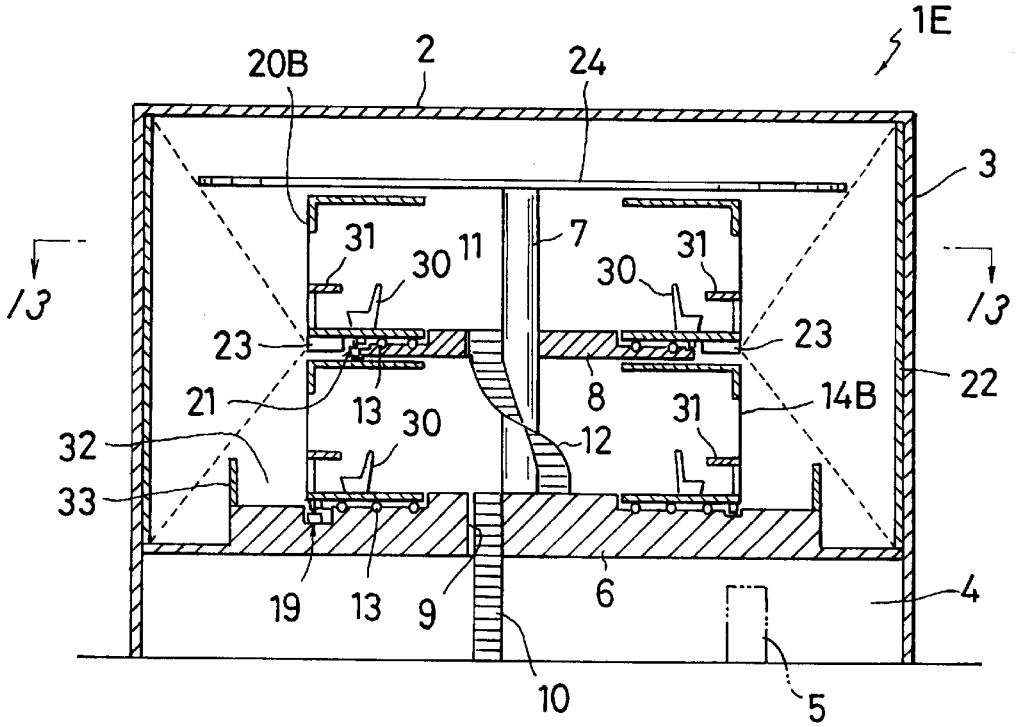
FIG. 12 is a vertical cross-sectional view showing a sixth embodiment of the present invention.
Figure 13:
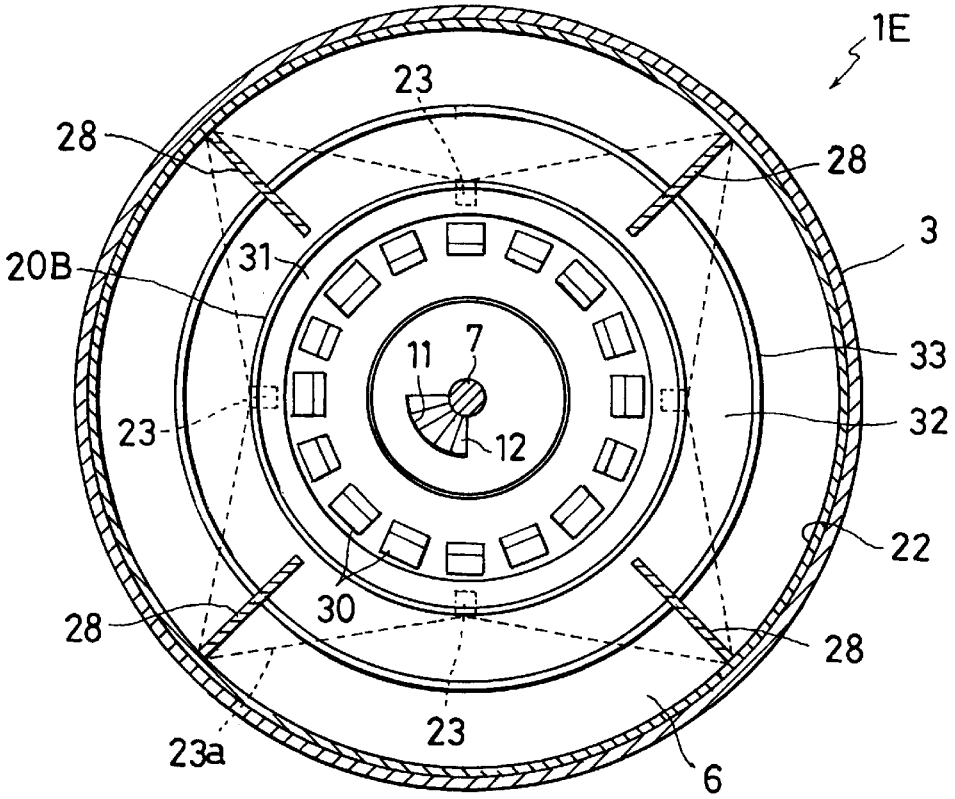
FIG. 13 is a cross-sectional view taken on line 13—13 of FIG. 12.

A sixth embodiment of the present invention is shown in FIGS. 12 and 13. It is distinguished from the fifth embodiment by the fact that a plurality of chairs 30 and tables 31 are furnished with a moving object 14B and 20B in order to use as a rotating-observation restaurant, the lower portion of the image is covered by a veranda 32. Also partition walls 28A, 28A, 28A, 28A are formed in the shape of a board. Accordingly, an establishment for viewing image 1E of the sixth embodiment may be used in this way.

Figure 14:
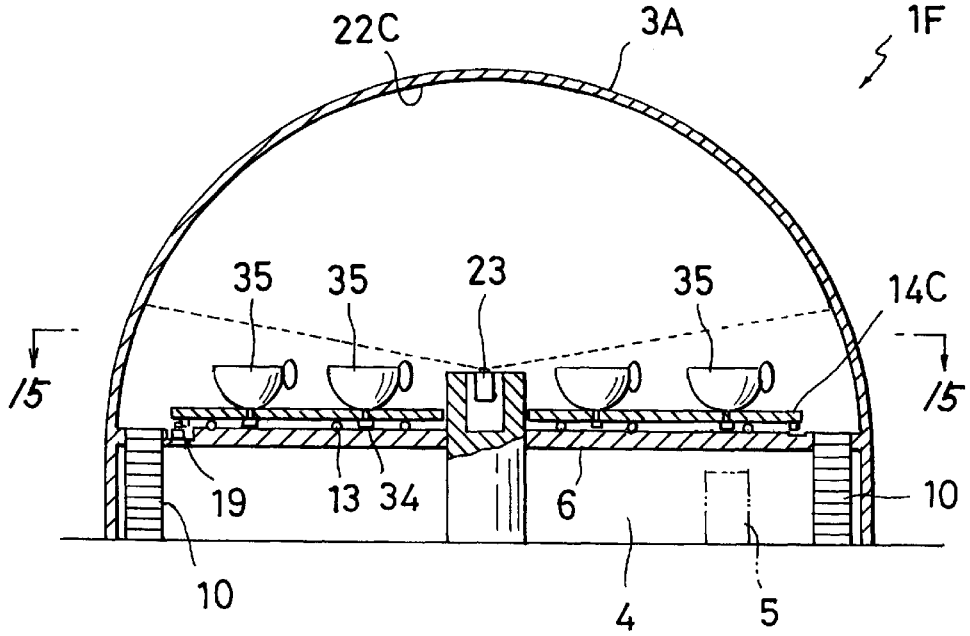
FIG. 14 is a vertical cross-sectional view showing a seventh embodiment of the present invention.
Figure 15:
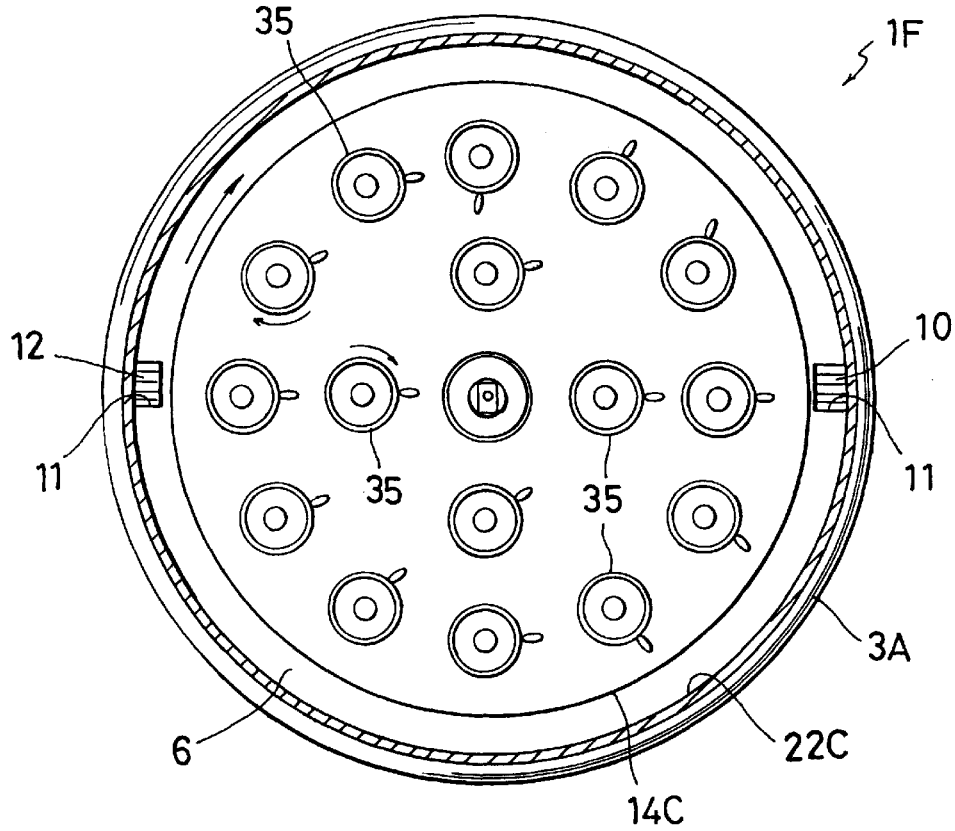
FIG. 15 is a cross-sectional view taken on line 15—15 of FIG. 14.

A seventh embodiment of the present invention is shown in FIGS. 14 and 15. It is distinguished from the first embodiment by the fact that building 3A is constructed such that its ceiling is formed as a concave screen 22C. Also, a moving object 14C having a plurality of rotating coffee cups 35 each serving as a guest seat driven rotatably by a rotating-drive device 34 is used, the projector 23 is provided at the central portion of the moving object 14C, the projector 23 projecting the image on the concave screen 22C. Accordingly, an establishment for viewing image 1F of the seventh embodiment may be used in this way.

Furthermore, a merry-go-round, bench or the like as a guest seat may be arranged at the moving object 14C.

Figure 16:
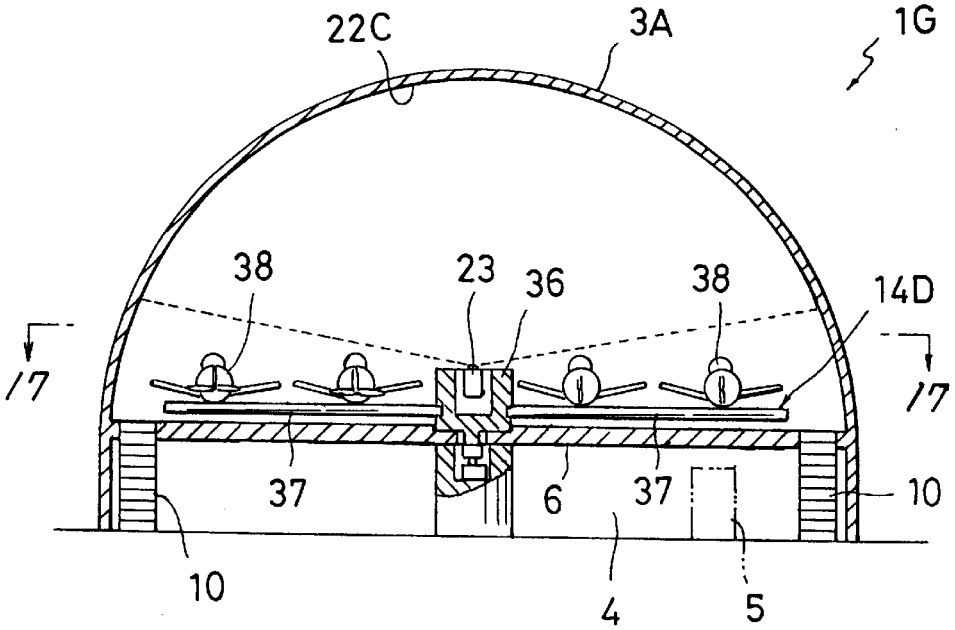
FIG. 16 is a vertical cross-sectional view showing an eighth embodiment of the present invention.
Figure 17:
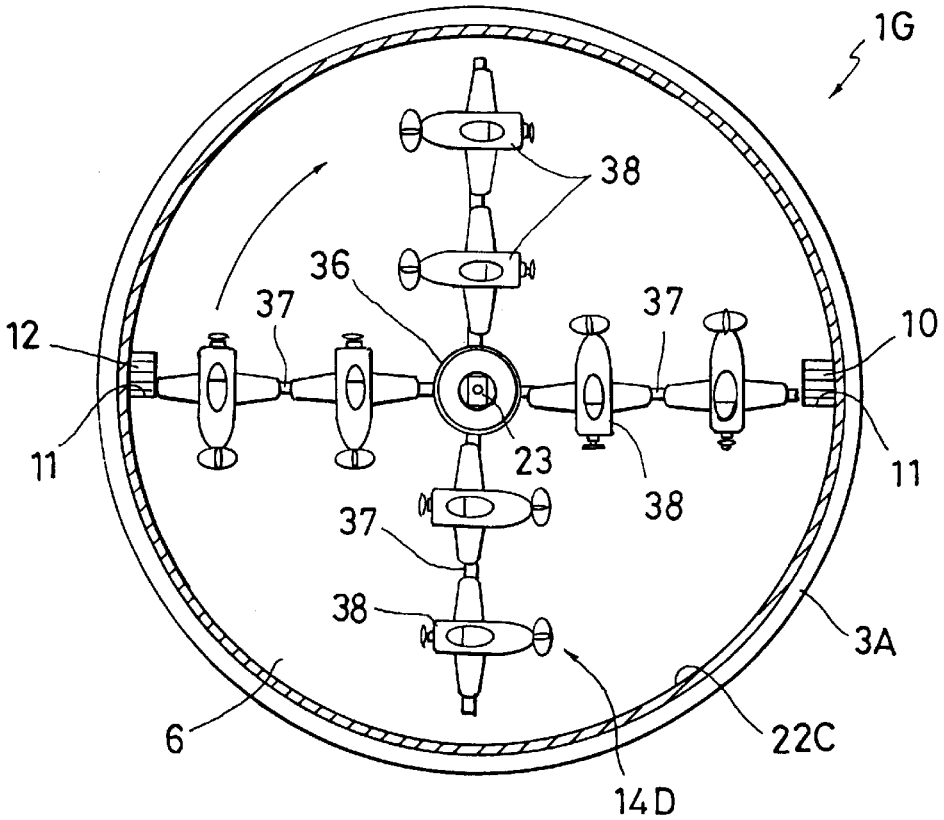
FIG. 17 is a cross-sectional view taken on line 17—17 of FIG. 16.

An eighth embodiment of the present invention is shown in FIGS. 16 and 17. It is distinguished from the seventh embodiment by the fact that the moving object 14C is replaced with another like moving object 14D and the move device 19 is replaced with another like device 19A The moving object 14D is further composed of a rotary shaft 36 provided at the central portion of the second floor surface 6, a plurality of supports 37 projected radially from the rotary shaft 36 in an outward diection, airplanes 38 as a seat for guest fixed to the plurality of supports 37. The move devioe 19A is further composed of a gear 39 fixed at outer circumferential portion of the lower part of the rotary shaft 36 allowed the moving object 14D to rotate and a motor 41 having a pinion 40 meshing with the gear 39. Accordingly, an establishment for viewing image 1G of the eighth embodiment may be used in this way.

Figure 18:
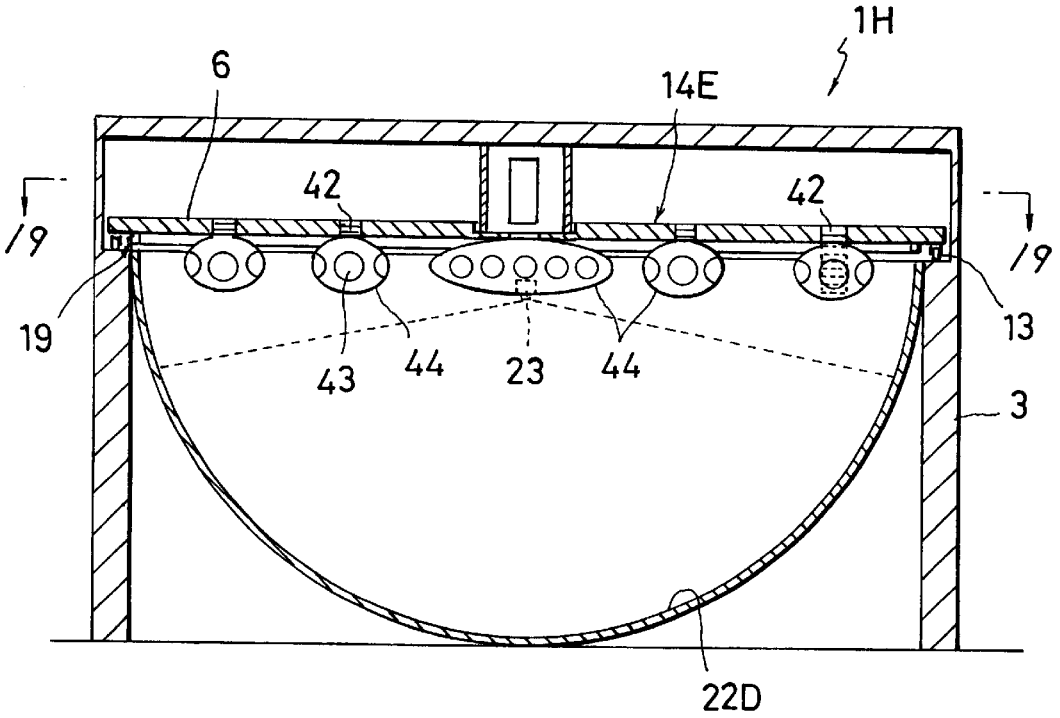
FIG. 18 is a vertical cross-sectional view showing a ninth embodiment of the present invention.
Figure 19:
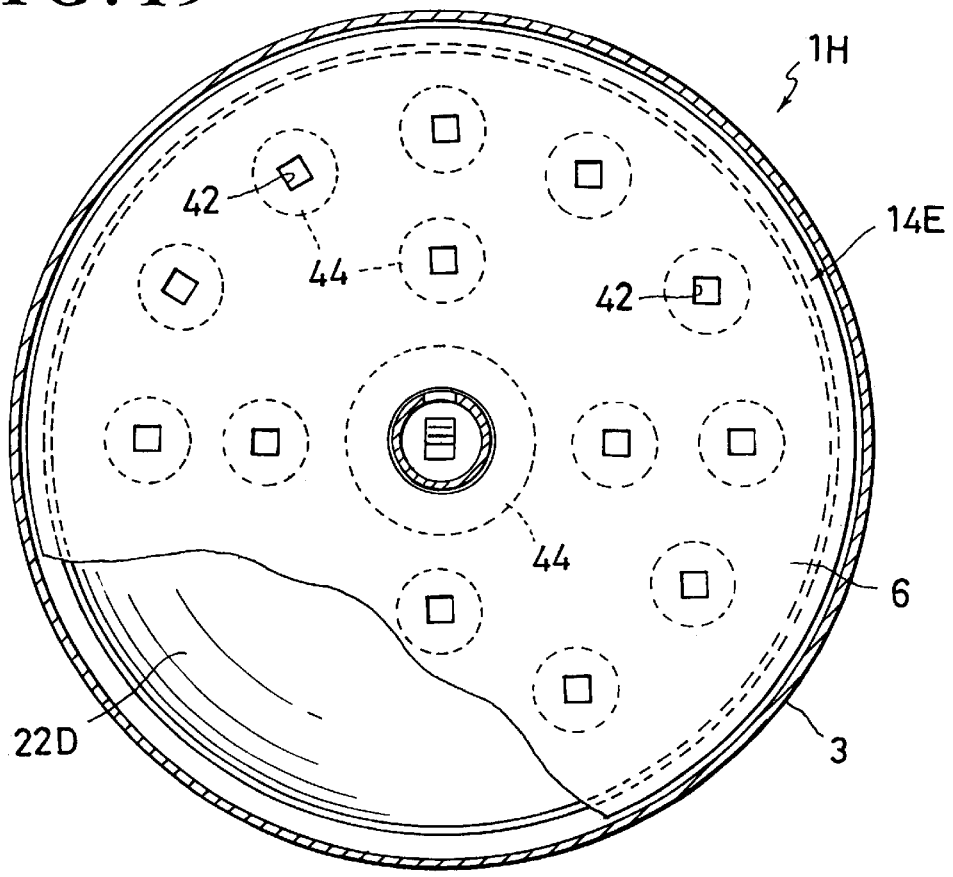
FIG. 19 is a cross-sectional view taken on line 19—19 of FIG. 18.

A ninth embodiment of the present invention is shown in FIGS. 18 and 19. It is distinguished from the first embodiment by the fact that a reverse-domed screen 22D is provided at the first floor portion, the sceen 22D opening an upper portion thereof. Also, the floor surface 6 for seeond floor is a moving object 14E allowed the floor surface 6 to be rotated by the move device 19, and a plurality of gondolas 44 are hung down from the lower surface of the moving object 14E, the gondolas 44 each having a window 43 respectively that the spectators 25 can ride therein through the upper opening 42. Accordingly, an establishment for viewing image 1H of the ninth embodiment may be used in this way.

Moreover, the establishment for viewing image 1H can produce a more realistic effect when as an image projected on the reverse-concave screen 22D is selected the image of scenery for ground viewed from the sky or for a bottom of the sea.

Furthermore, the gondolas 44 may be provided movably in upward and downward directions without fixing to the moving object 14E.

Figure 20:
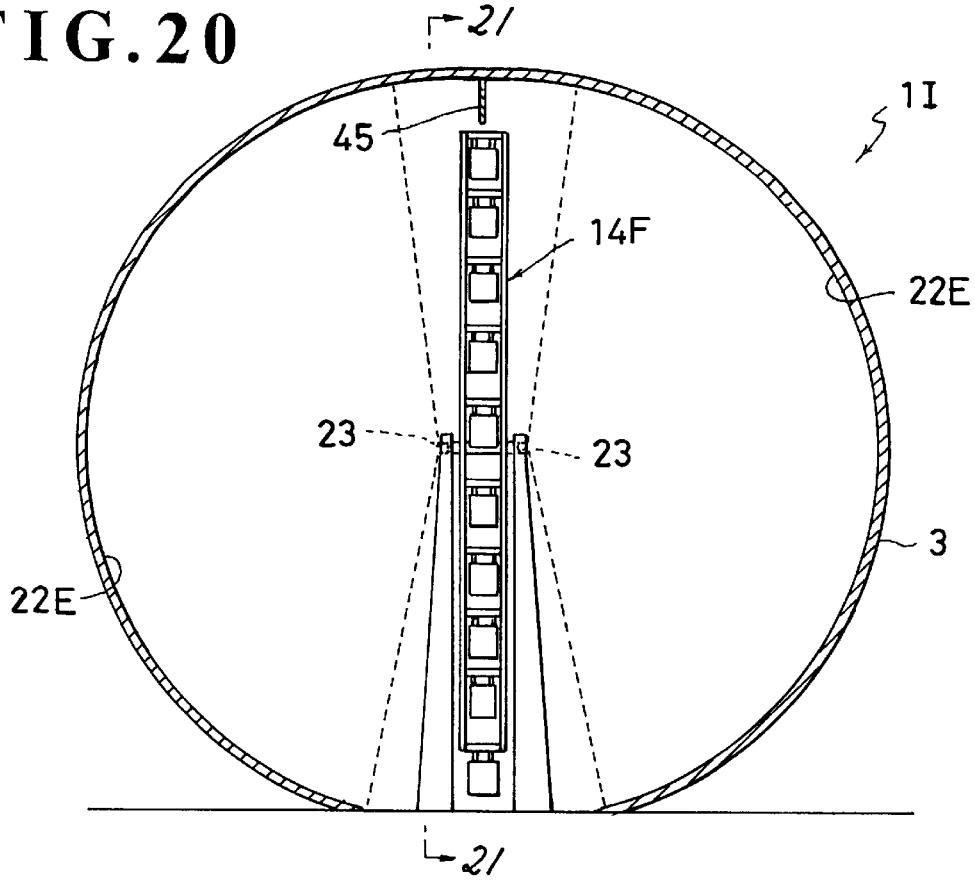
FIG. 20 is a vertical cross-sectional view showing a tenth embodiment of the present invention.
Figure 21:
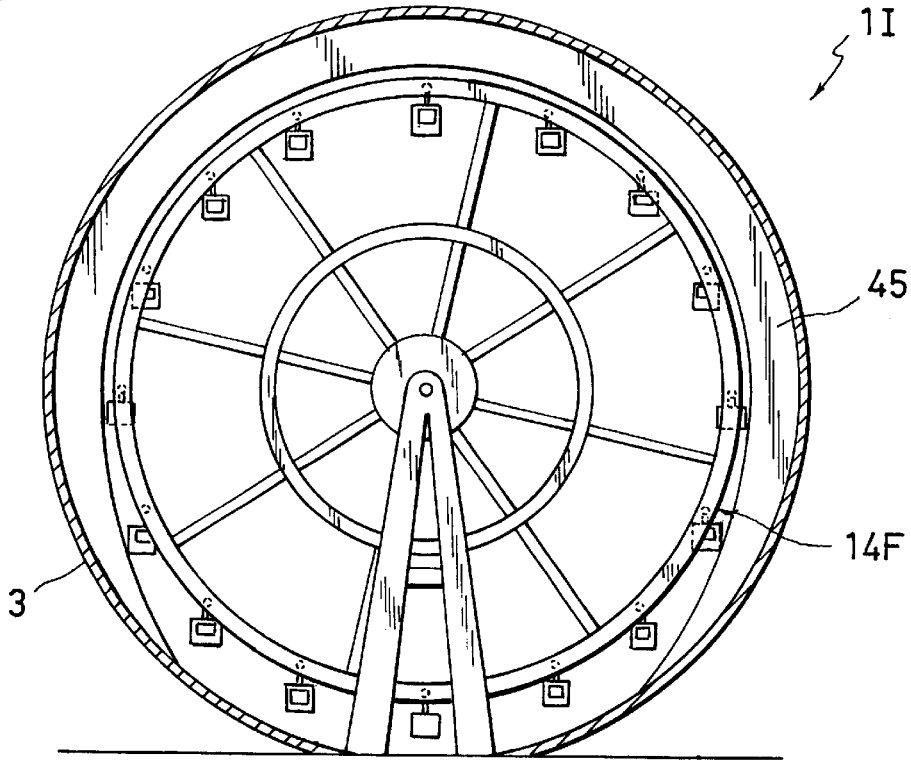
FIG. 21 is a cross-sectional view taken on line 21—21 of FIG. 20.

A tenth embodiment of the present invention is shown in FIGS. 20 and 21. It is distinguished from the seventh embodiment by the fact that a moving object 14F is formed in the shape of a Ferris wheel and vertical concave screens 22E, 22E are arranged such that the screens 22E cover both side faces of the moving object 14F. Acordingly, an establishment for viewing image 11 of the tenth embodiment may be used in this way.

Moreover, numeral 45 is a blackout shield which prevents diffused reflection from the screens 22E to the space between the moving object 14E and the screens 22E.

Figure 22:
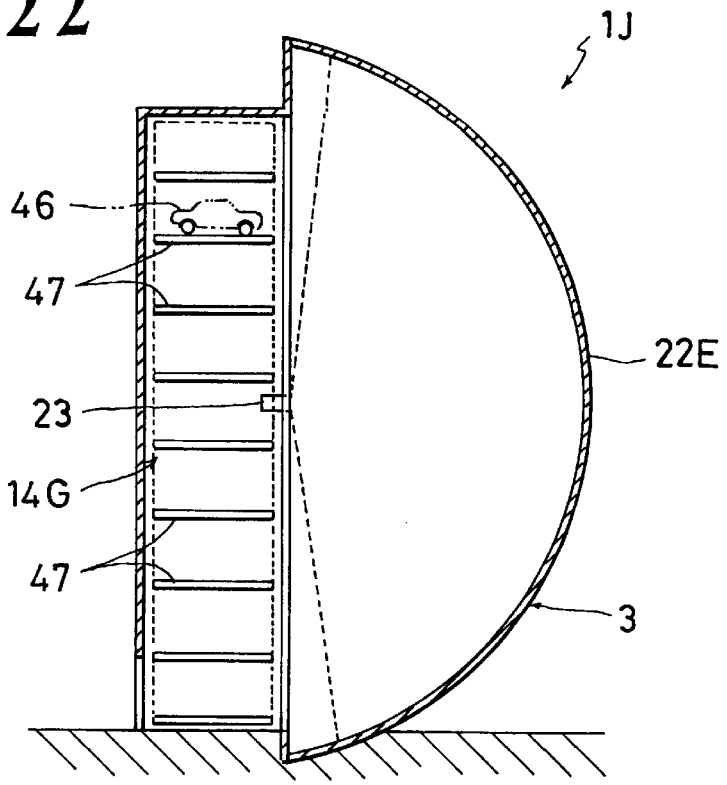
FIG. 22 is a vertical cross-sectional view showing an eleventh embodiment of the present invention.
Figure 23:
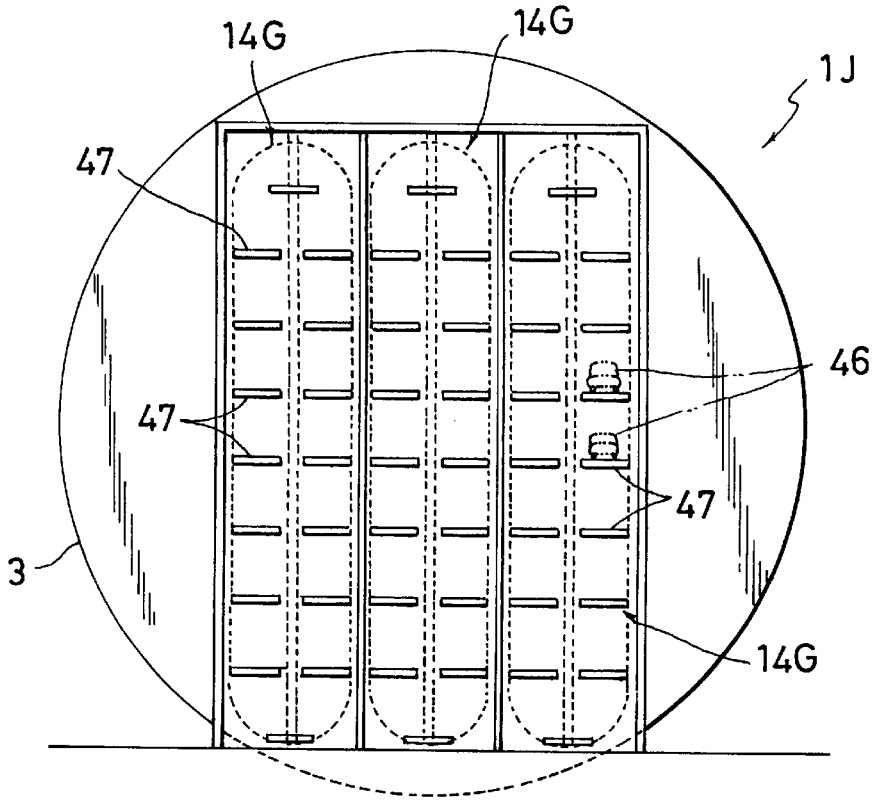
FIG. 23 is a front view showing an eleventh embodiment of the present invention.

An eleventh embodiment of the present invention is shown in FIGS. 22 and 23. It is distinguished from the tenth embodiment by the fact that a moving object 14G is a three-set-typed parking device which is formed in the shape of a tower, the moving object 14G having a plurality of pallets 47 which house cars 46 thereon. Also, a vertical concave screen 22E is arranged at one side of the moving object 14G. Accordingly, in an establishment for viewing image 1J of the eleventh embodiment, the spectators 25 can enjoy viewing the image projected on the concave screen 22E while they ride in the car.

Moreover, the moving object 14G may be constructed any kind of structures provided that the moving object 14G is used as a parking device in the shape of a tower.

Figure 24:
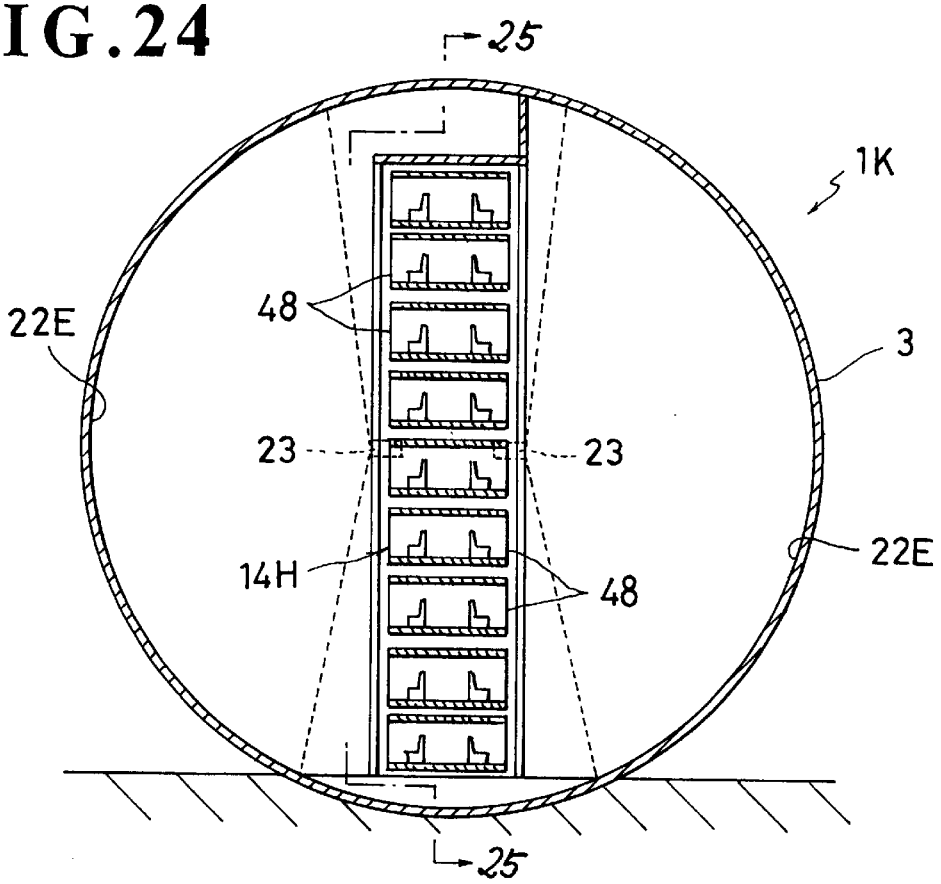
FIG. 24 is a vertical cross-sectional view showing a twelfth embodiment of the present invention.
Figure 25:
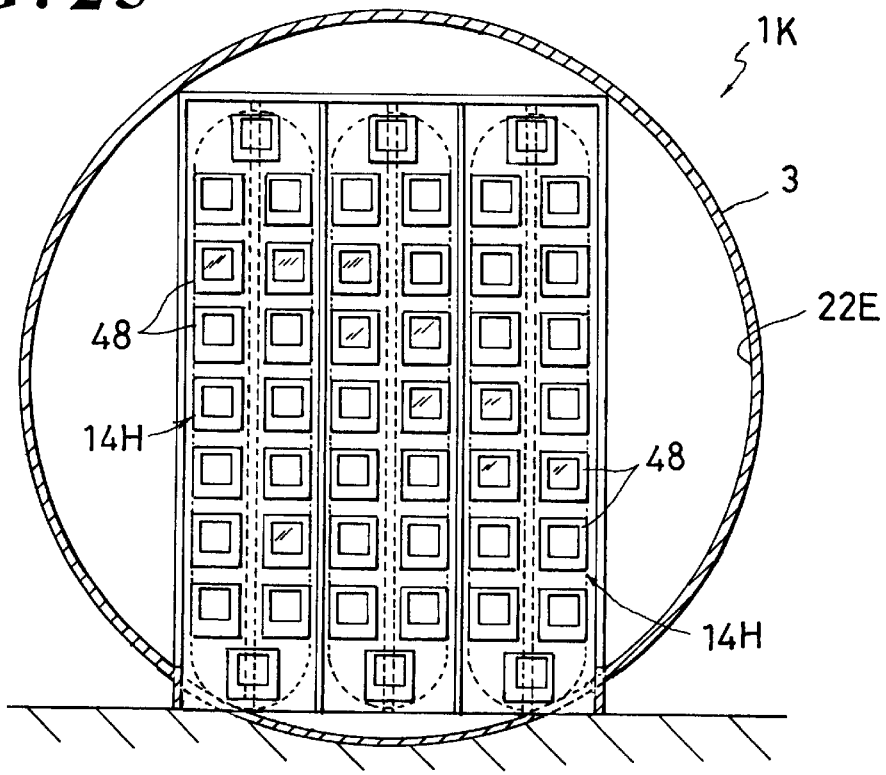
FIG. 25 is a cross-sectional view taken on line 25—25 of FIG. 24.

A twelfth embodiment of the present invention is shown in FIGS. 24 and 25. It is distingished from the eleventh embodiment by the fact that a moving object 14H includes a plurality of gondolas 48, the screens 22H are arranged such that the screens 22H cover both side faces of the moving object 14H. Accordingly, an establishment for viewing image 1K of the twelfth embodiment may be used in this way.

Figure 26:
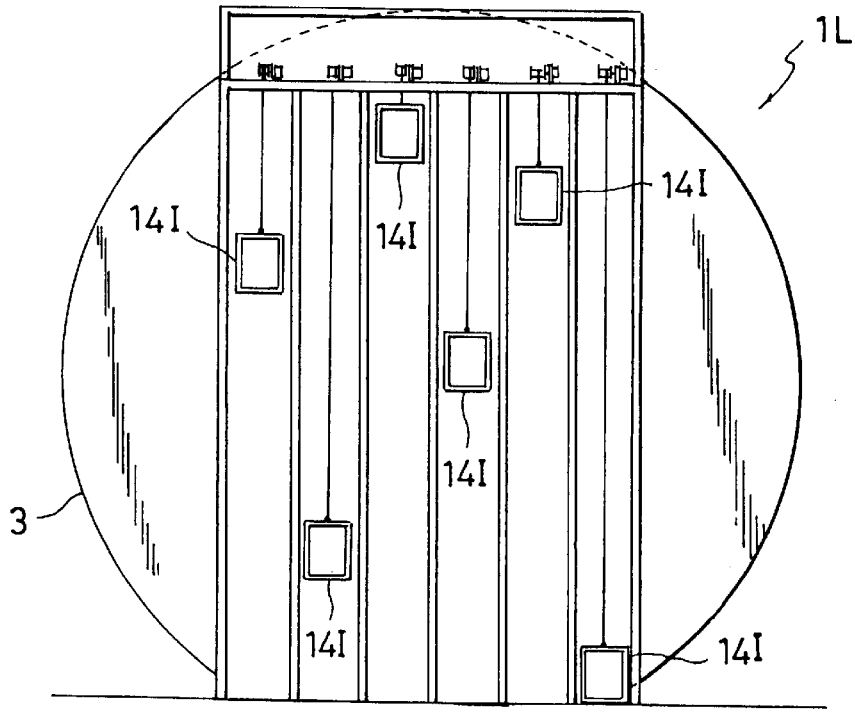
FIG. 26 is a front view showing a thirteenth embodiment of the present invention.
Figure 27:
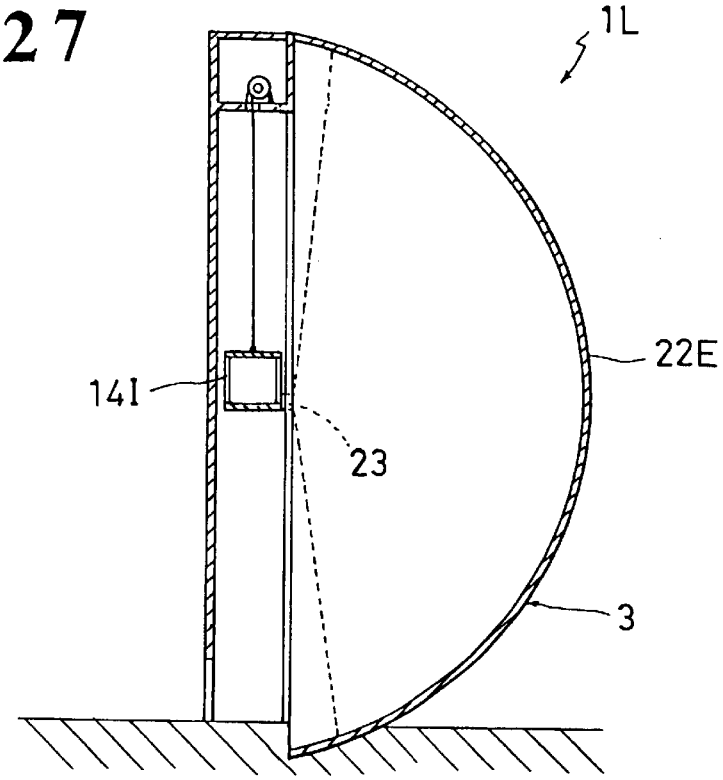
FIG. 27 is a vertical cross-sectional view showing a thirteenth embodiment of the present invention.

A thirteenth embodiment of the present invention is shown in FIGS. 26 and 27. It is distinguished from the eleventh embodiment by the fact that a plurality of moving objects 14I, 14I, 14I, 14I are formed in the shape of an elevator for viewing respectively. Accordingly, an establishment for viewing image 1L of the thirteenth embodiment may be used in this way.

Figure 28:
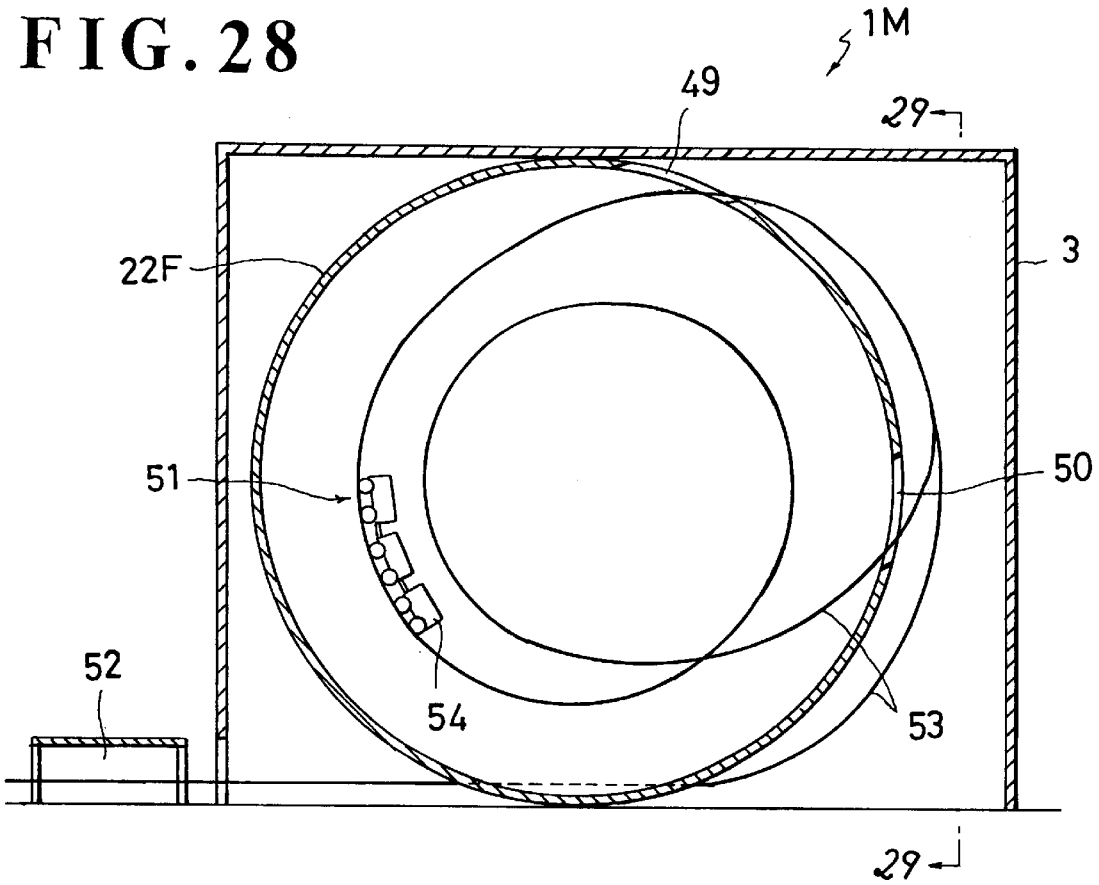
FIG. 28 is a vertical cross-sectional view showing a fourteenth embodiment of the present invention.
Figure 29:
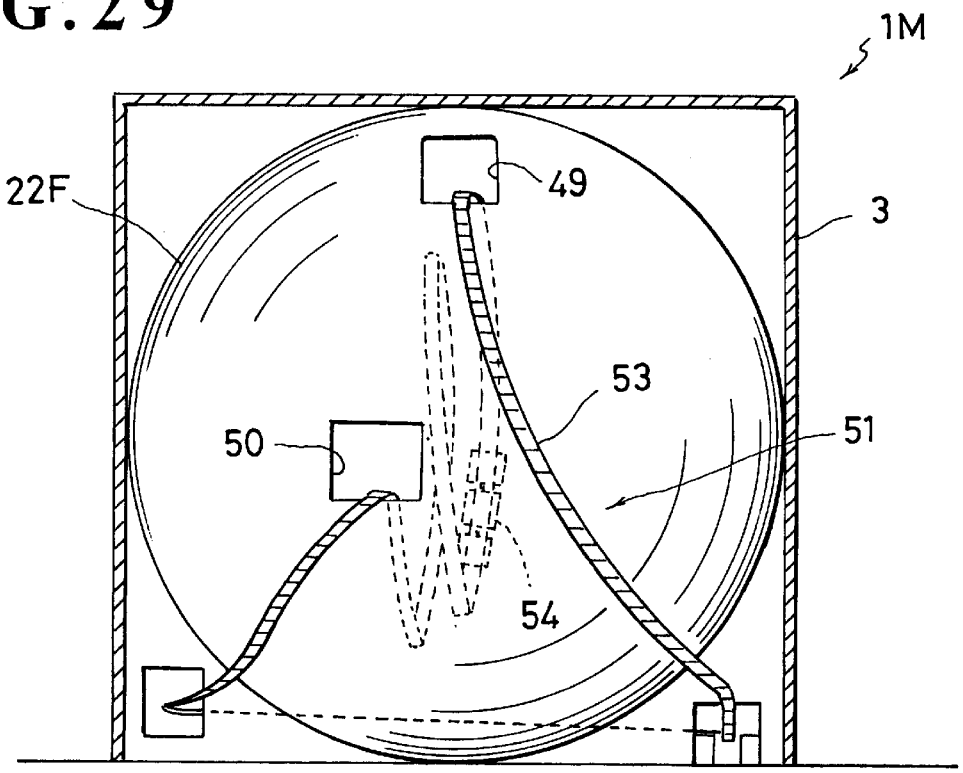
FIG. 29 is a cross-sectional view taken on line 29—29 of FIG. 28.

A fourteenth embodiment of the present invention is shown in FIGS. 28 and 29. It is distinguished from the tenth embodiment by the fact that a screen 22F in the shape of a sphere is provided, and a roller coaster 51 is provided such that the roller coaster can go in and out the screen 22F through an entrance 49 and an ext 50 of the screen 22F. Accordingly, an establishment for viewing image 1M of the fourteenth embodiment may be used in this way.

Moreover, the roller coaster 51 is further composed of a roller coaster track 53 is provided such that the track 53 circulates into the screen 22F from a platform 52 and cars 54 as a moving object run on the roller coaster track 53.

Figure 30:
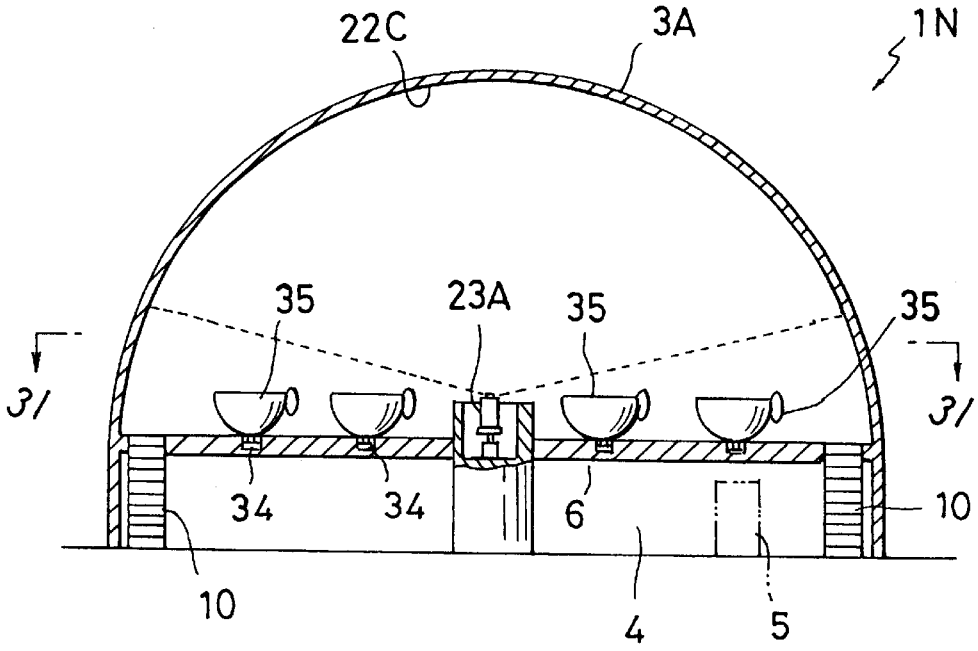
FIG. 30 is a vertical cross-sectional view showing a fifteenth embodiment of the present invention.
Figure 31:
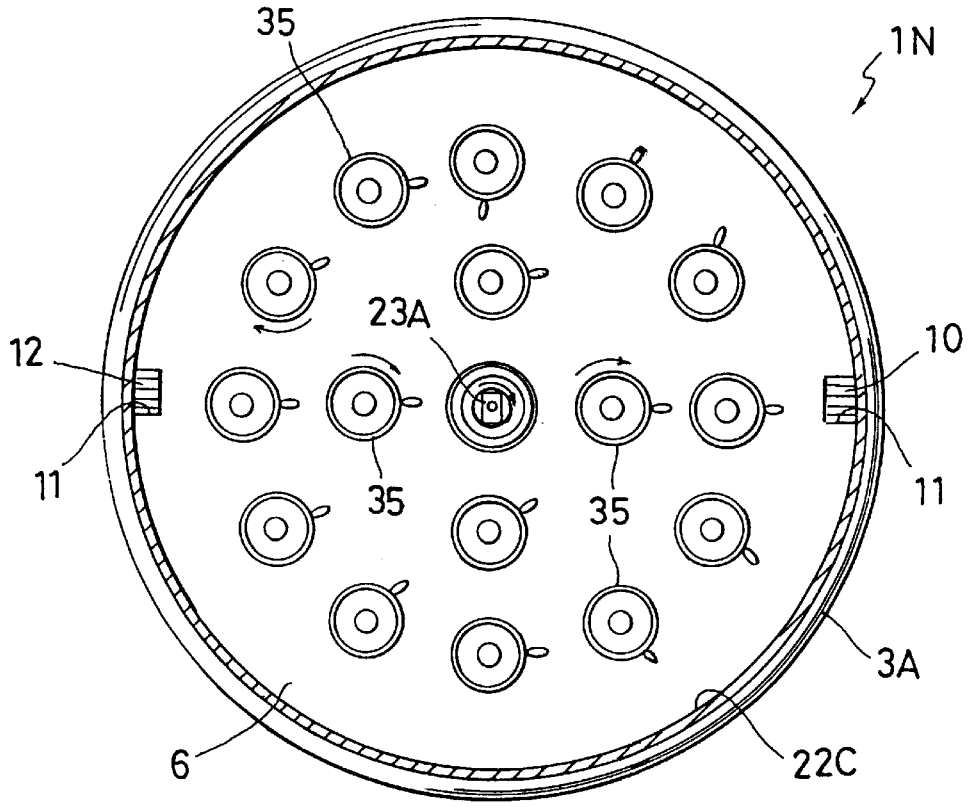
FIG. 31 is a coss-sectional view taken on line 31—31 of FIG. 30.

A fifteenth embodiment of the present invention is shown in FIGS. 30 and 31. It is distinguished from the seventh embodiment by the fact that the revolving coffee cups 35 as a seat for guest driven rotatably by the rotary-drive device 34 is mounted on the floor surface 6 for second floor, and the projector 23A can project the rotating image on the concave screen 22C thereby. Accordingly, an establishment for viewing image 1N of the fifteenth embodiment may be used in this way.

Figure 32:
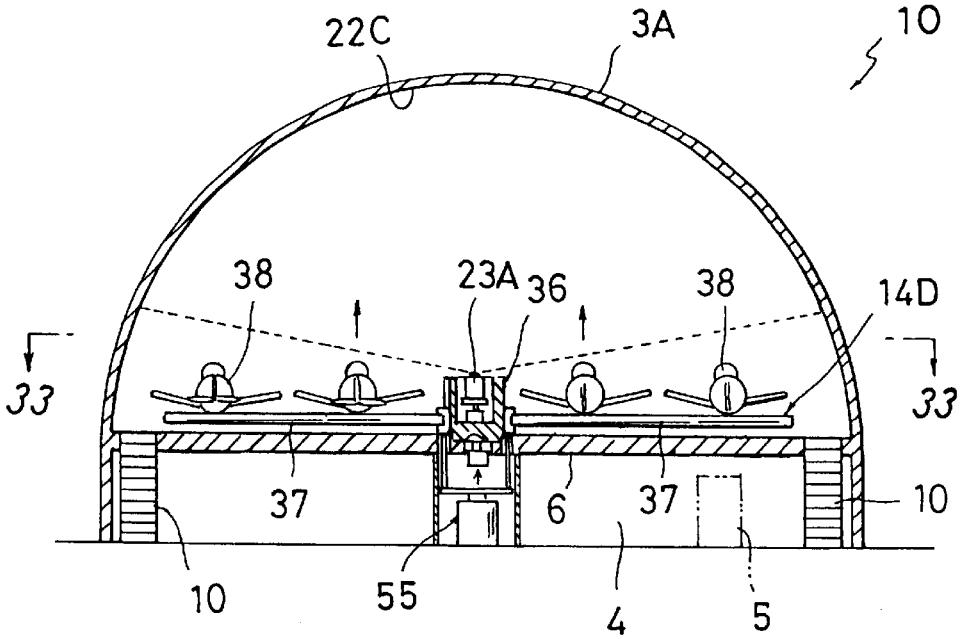
FIG. 32 is a vertical cross-sectional view showing a sixteenth embodiment of the present invention.
Figure 33:
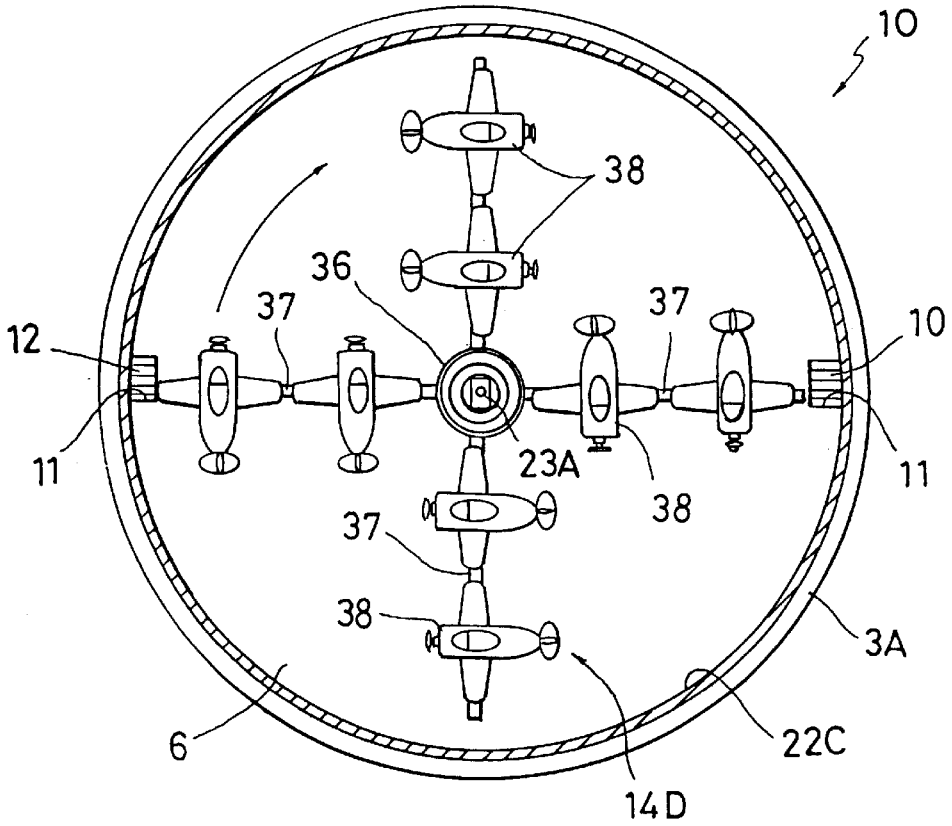
FIG. 33 is a cross-sectional view taken on line 33—33 of FIG. 32.

A sixteenth embodiment of the present invention is shown in FIGS. 32 and 33. It is distinguished from the eighth embodiment by the fact that a plurality of supports 37 allow them to move upwardly and downwardly by an up-and-down move system 55 makes the supports 37 move in upward and downward directions. Also, the projector 23A can project the rotating image on the concave screen 22C thereby. Accordingly, an establishment for viewing image 10 of the sixteenth embodiment may be used in this way.

Figure 34:
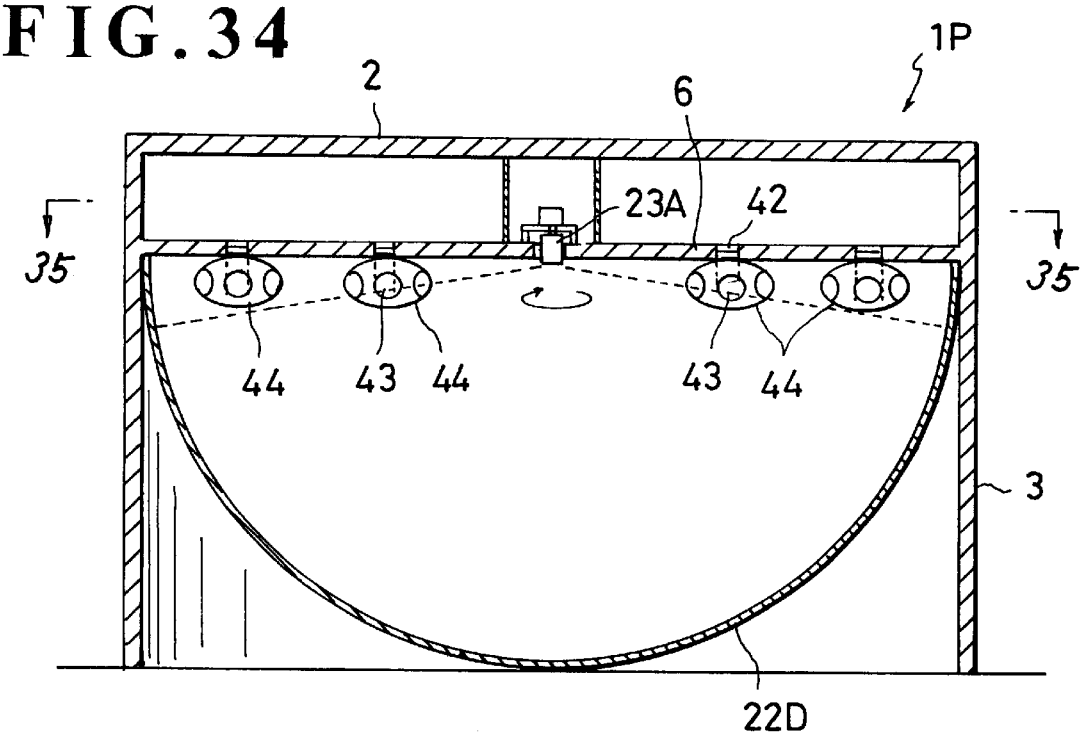
FIG. 34 is a vertical cross-sectional view showing a seventeenth embodiment of the present invention.
Figure 35:
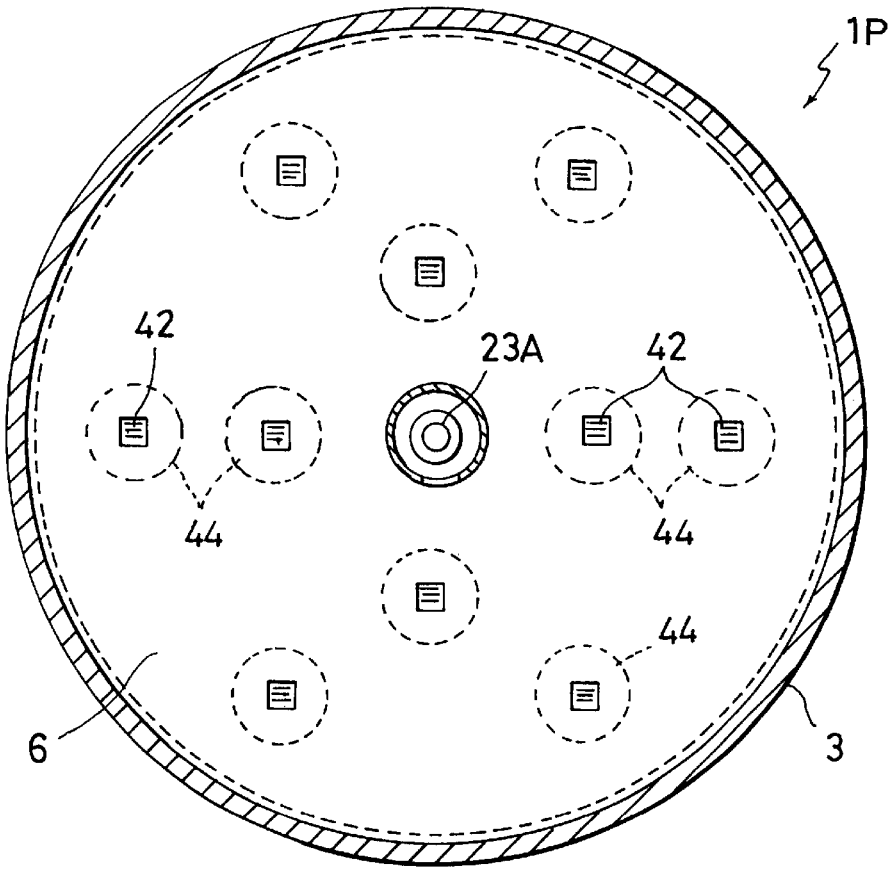
FIG. 35 is a cross-sectional view taken on line 35—35 of FIG. 34.

A seventeenth embodiment of the present invention is shown in FIGS. 34 and 35. It is distinguished from the ninth embodiment by the fact that the gondolas 44 hang down the bottom surface of the floor surface 6 for second floor, the gondolas 44 having a window 43 respectively such that the spectators 25 can ride therein from the upper opening 42, and the projectors 23A can project the rotating image on the concave screen 22D thereby. Accordingy, an establishment for viewing image 1P of the seventeenth embodiment may be used in this way.

Figure 36:
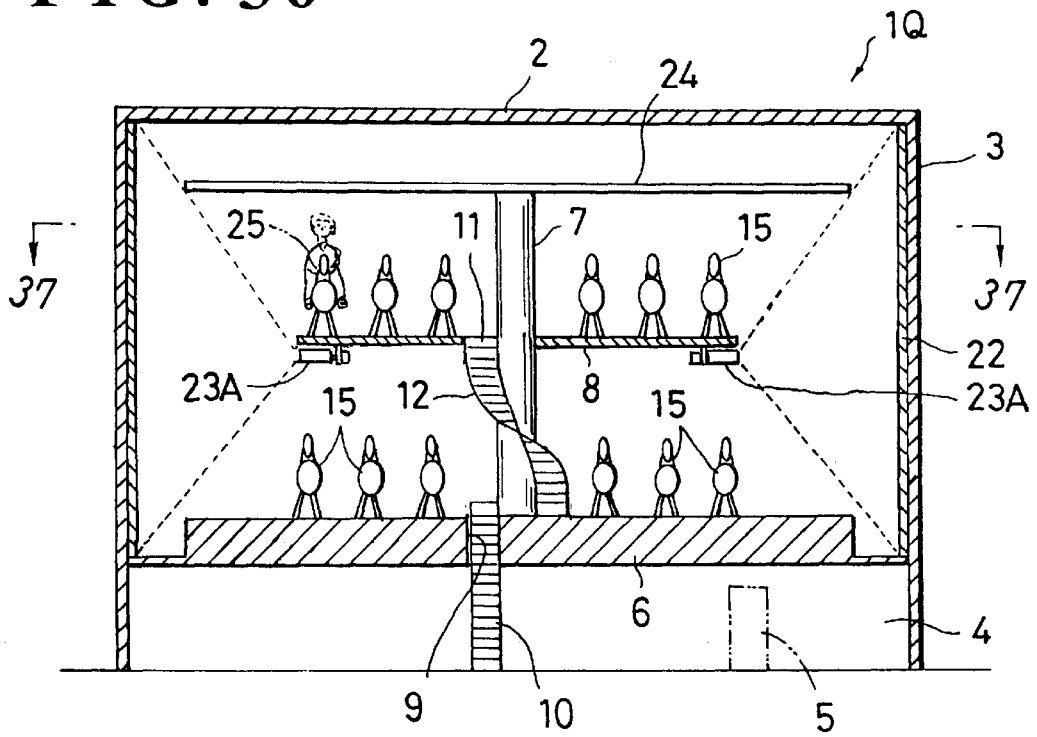
FIG. 36 is a vertical cross-sectional view showing an eighteenth embodiment of the present invention.
Figure 37:
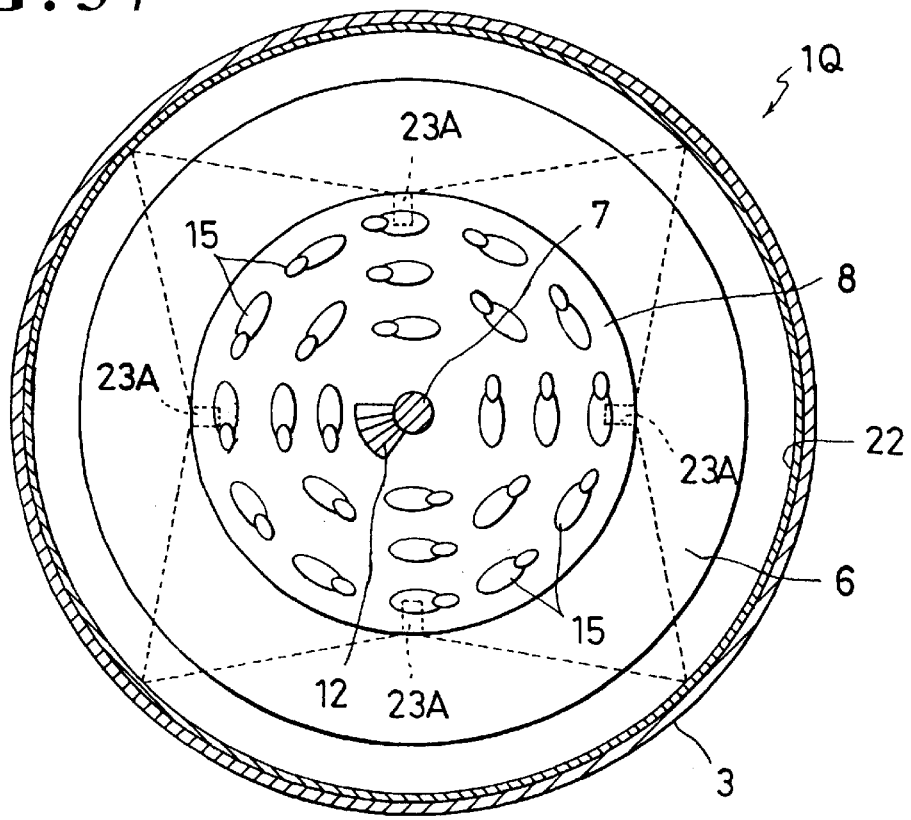
FIG. 37 is a cross-sectional view taken on line 37—37 of FIG. 36.

An eighteenth embodiment of the present invention is shown in FIGS. 36 and 37. It is distinguished from the first embodiment by the fact that a plurality of wooden horses 15 as a seat for guest respectively, and the projectors 23A can project the rotating image on the screen 22 in the shape of a cylinder. Accordingly, an establishment for viewing image 1Q of the seventeenth embodiment may be used in this way.

Figure 38:
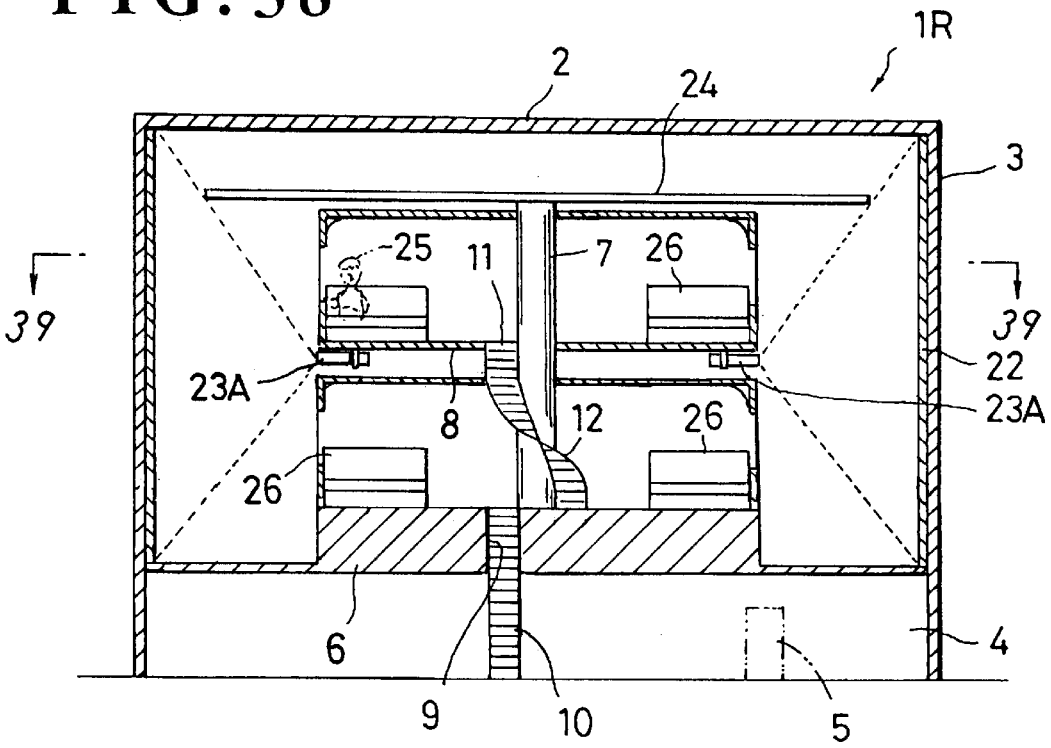
FIG. 38 is a vertical cross-sectional view showing a nineteenth embodiment of the present invention.
Figure 39:
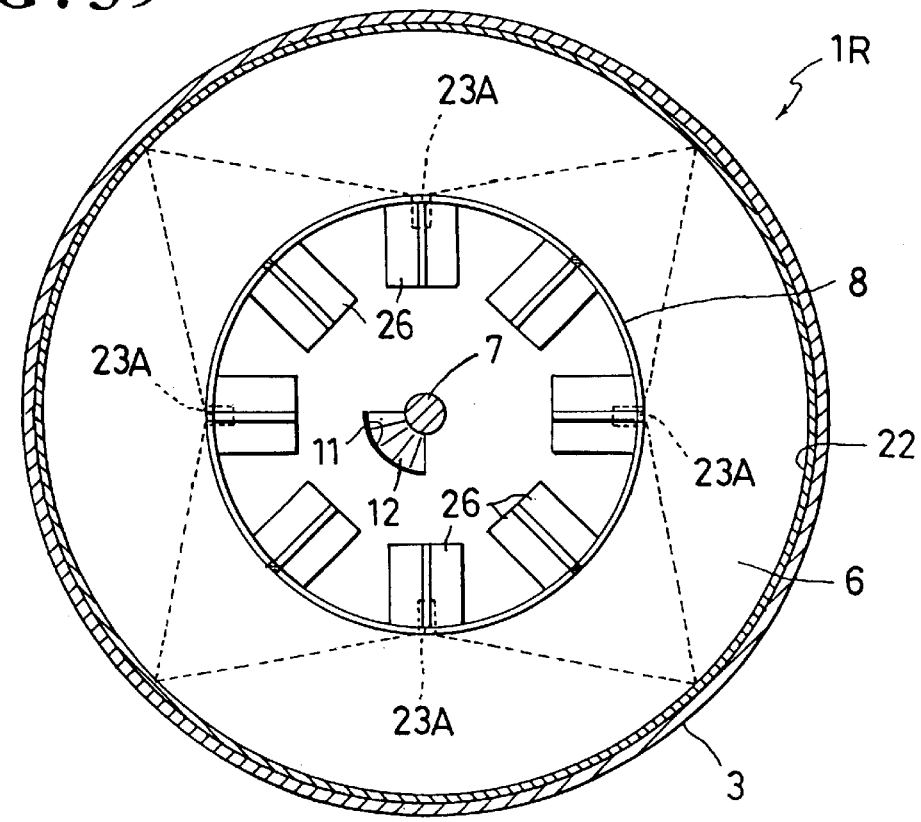
FIG. 39 is a cross-sectional view taken on line 39—39 of FIG. 38.

A nineteenth embodiment of the present invention is shown in FIGS. 38 and 39. It is distinguished from the seoond embodiment by the fact that face-to-face-type seat 26, similar to a cabin of a train, are mounted fixedly on the floor surfaces 6 and 8 respectively, and the projectors 23A can project the rotating image on the screen 22 in the shape of a cylinder. Accordingly, an establishment for viewing image 1R of the nineteenth embodiment may be used in this way.

Figure 40:
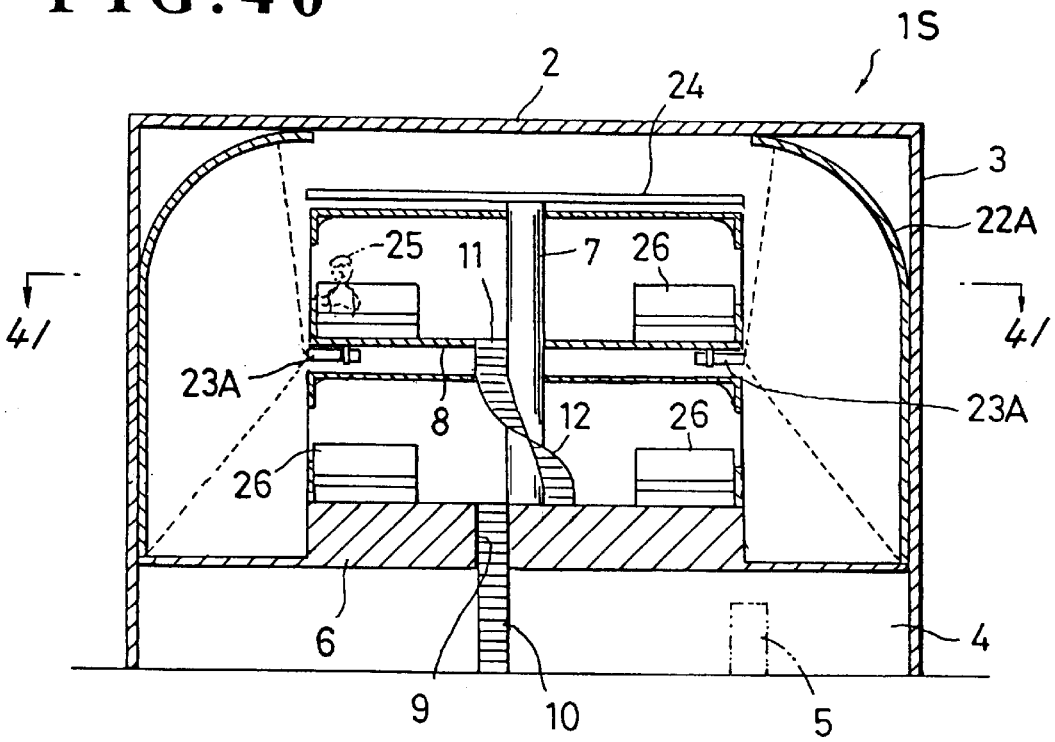
FIG. 40 is a vertical cross-sectional view showing a twentieth embodiment of the present invention.
Figure 41:
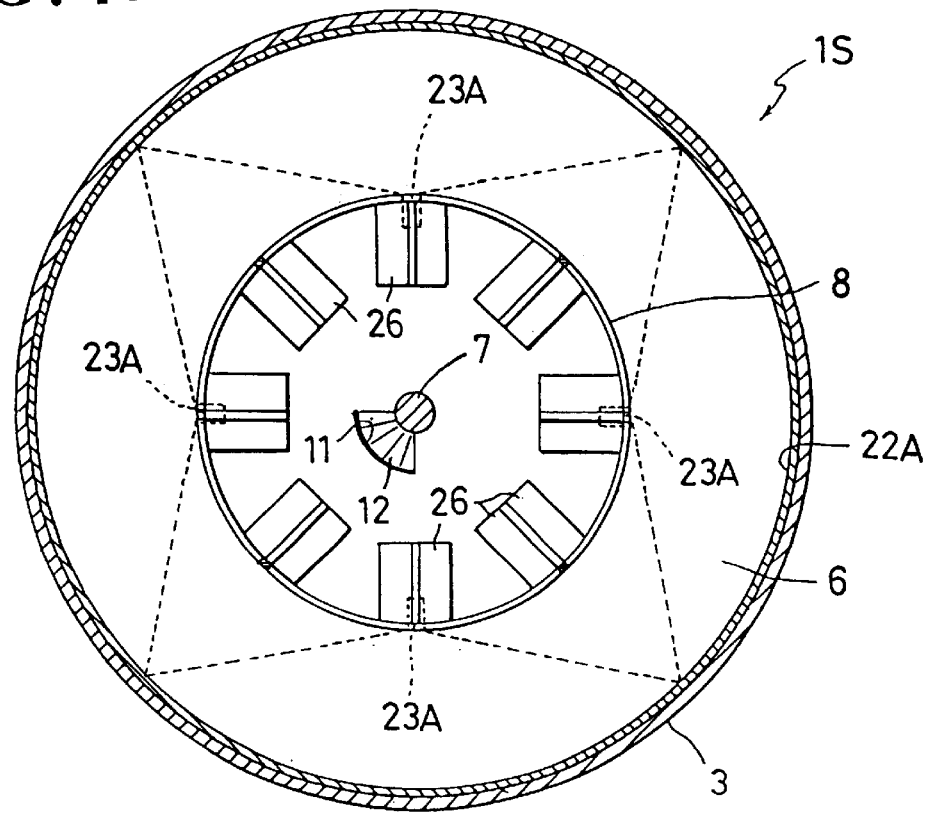
FIG. 41 is a cross-sectional view taken on line 41—41 of FIG. 40.

A twentieth embodiment of the present invention is shown in FIGS. 40 and 41. It is distinguished from the third embodiment by the fact that face-to-face-type seat 26, similar to a cabin of a train, are mounted fixedly on the floor surfaces 6 and 8 respectively, and the projectors 23A can project the go-round image on the screen 22 in the shape of a cylinder, the screen 22 bending in an inner direction at the upper portion thereof. Accordingly, an establishment for viewing image 1S of the twentieth embodiment may be used in this way.

Figure 42:
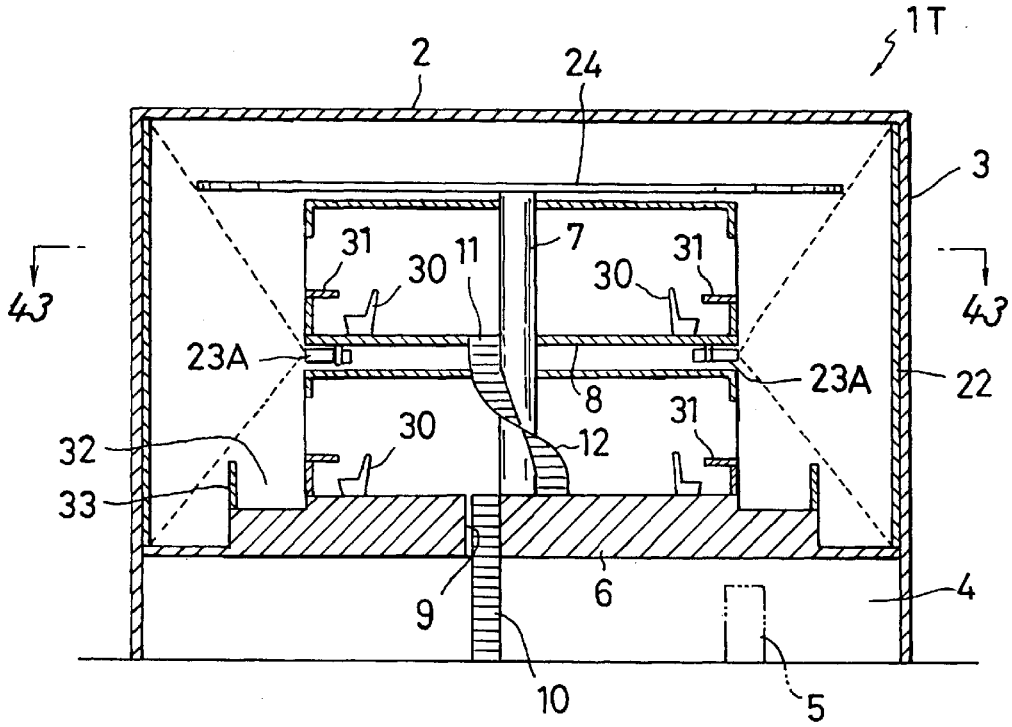
FIG. 42 is a vertical cross-sectional view showing a twenty-first embodiment of the present invention.
Figure 43:
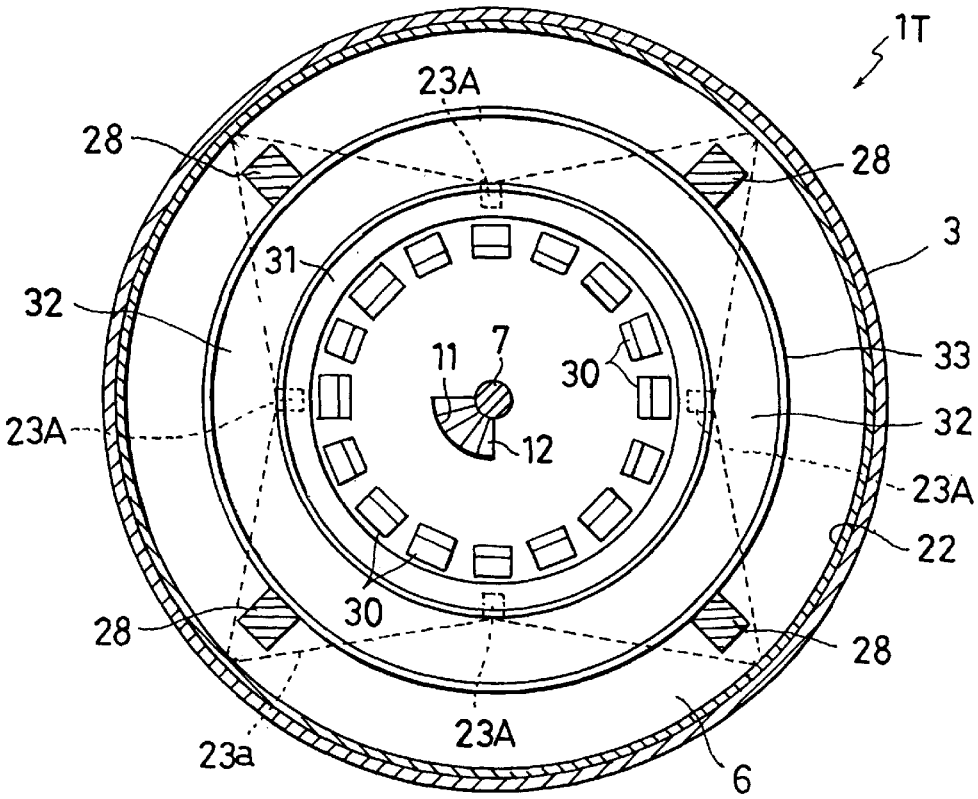
FIG. 43 is a cross-sectional view taken on line 43—43 of FIG. 42.

A twenty-first embodiment of the present invention is shown in FIGS. 42 and 43. It is distinguished from the sixth embodiment by the fact that a plurality of chaars 30 and tables 31 are furnished with a moving object 14B and 20B in order to use as a rotating observation restaurant, the lower portion of the image is covered by a veranda 32, and the projectors 23A can project the rotating image on the screen 22 in the shape of a cylinder. Accordingly, an establishment for viewing image 1T of the twenty-first embodiment may be used in this way.

Figure 44:
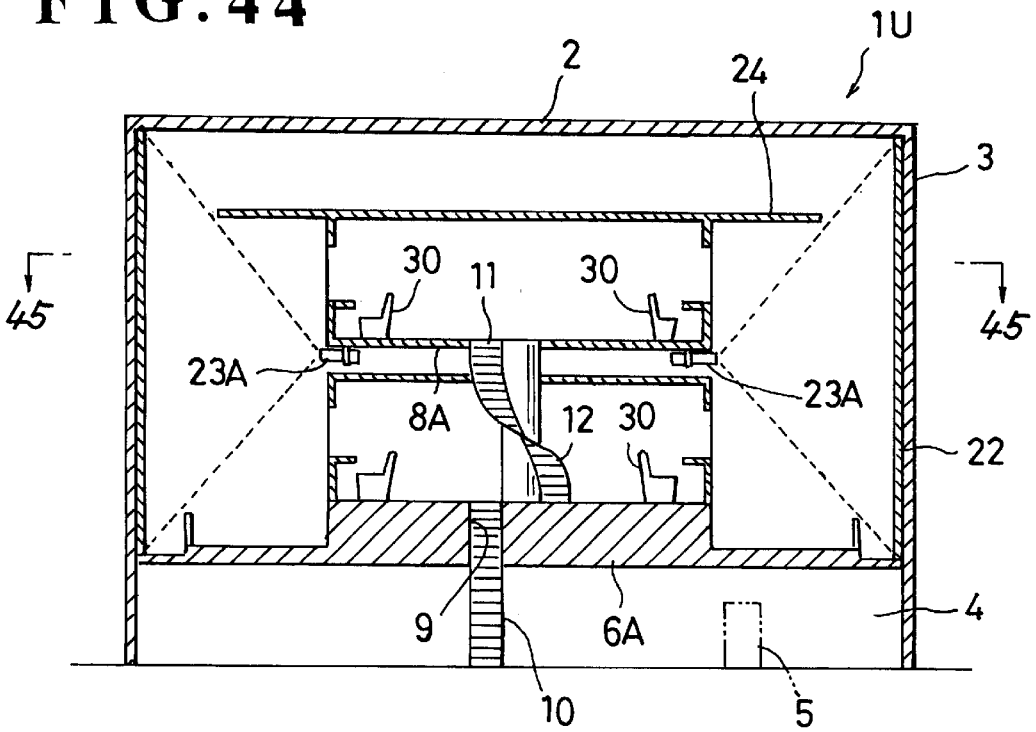
FIG. 44 is a vertical cross-sectional view showing a twenty-second embodiment of the present invention.
Figure 45:
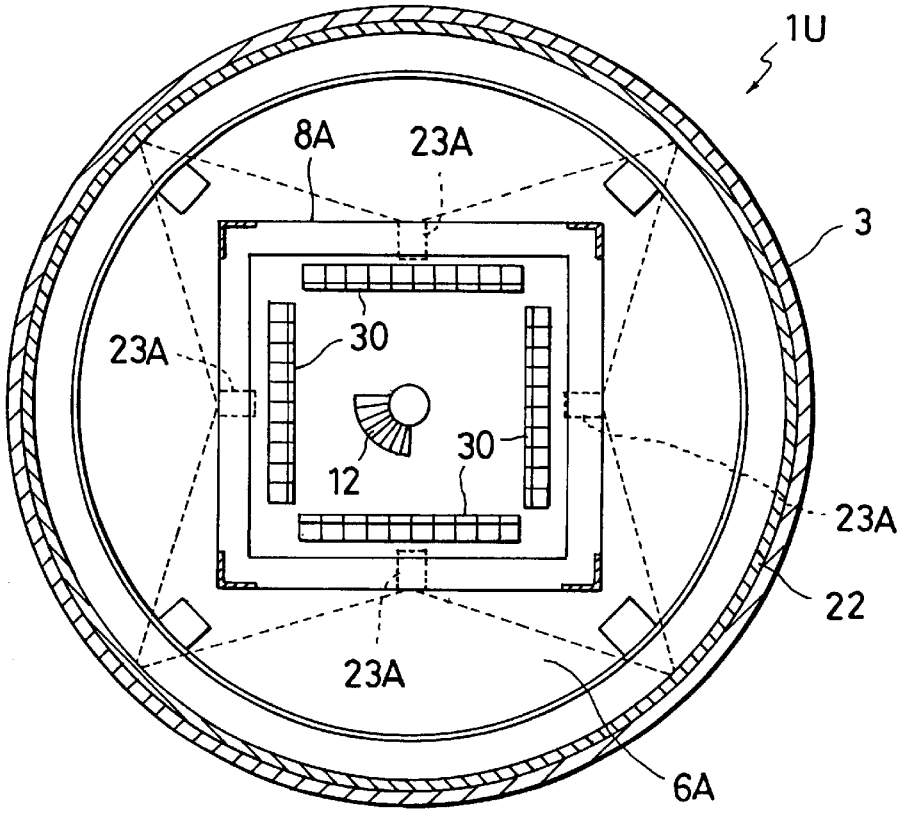
FIG. 45 is a cross-sectional view taken on line 45—45 of FIG. 44.

A twenty-second embodiment of the present invention is shown in FIGS. 44 and 45. It is distinguished from the nineteenth embodiment by the fact that the floor surfaces 6 and 8 are formed in the shape of a square. Accordingly, an establishment for viewing image 1U of the twenty-second embodiment may be used in this way.

Figure 46:
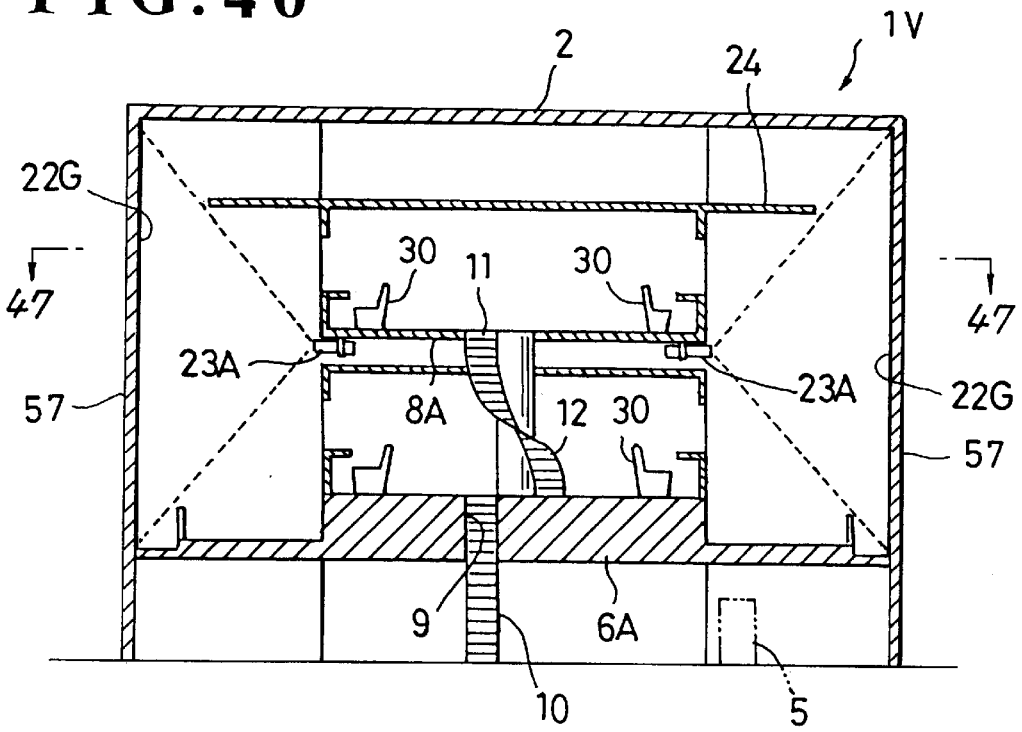
FIG. 46 is a vertical cross-sectional view showing a twenty-third embodiment of the present invention.
Figure 47:
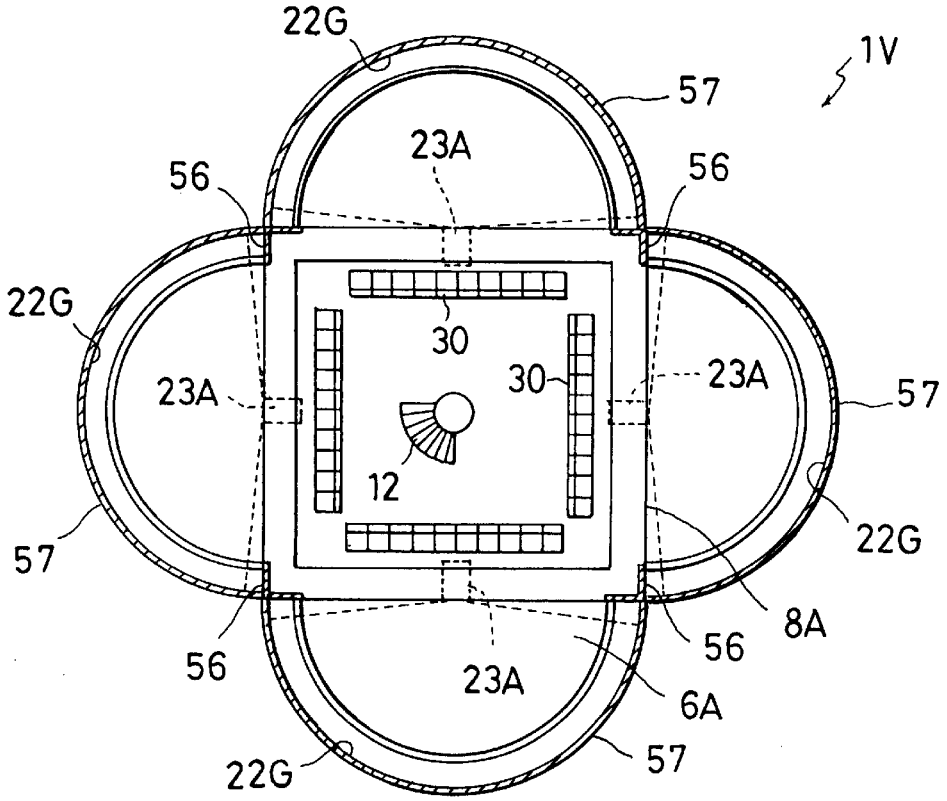
FIG. 47 is a cross-sectional view taken on line 47—47 of FIG. 46.

A twenty-third embodiment of the present invention is shown in FIGS. 46 and 47. It is distinguished from the twenty-second embodiment by the fact that semi-cylindrical screen 22G, 22G, 22G, 22G are provided at inner wall surface of the inner walls which cover in the shape of a semicircular respectively between props 56, 56, 56, 56 located at the four corners of the floor surface 6A for second floor and floor surface 8A for the mezzanine. Accordingly, an establishment for viewing image 1V of the twenty-third embodiment may be used in this way.

Figure 48:
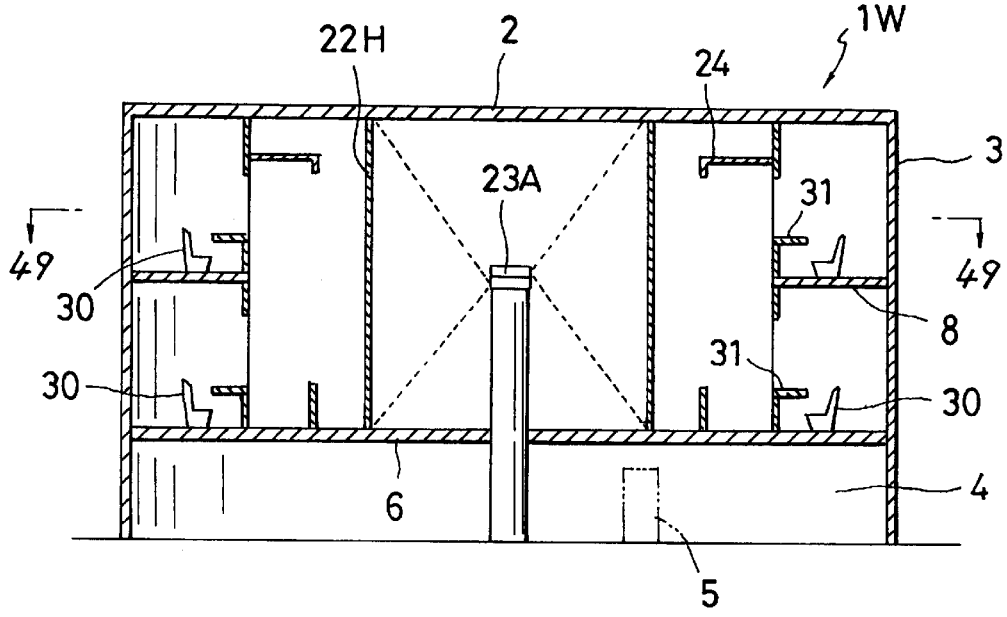
FIG. 48 is a vertical cross-sectional view showing a twenty-fourth embodiment of the present invention.
Figure 49:
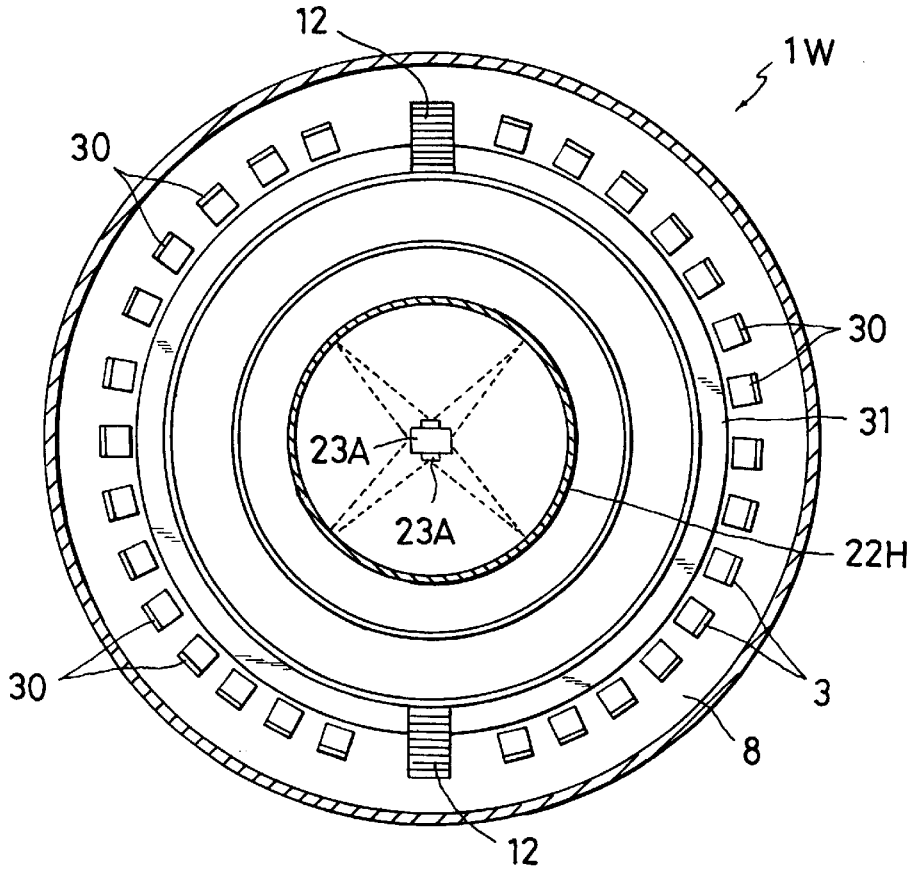
FIG. 49 is a cross-sectional view taken on line 49—49 of FIG. 48.

A twenty-fourth embodiment of the present invention is shown in FIGS. 48 and 49. It is distinguished from the twenty-first embodiment by the fact that a cylidrical screen 22H is located at the central portion, the plurality of chairs 30 and tables 31 are arranged at outer circumferential portion in the screen 22H and the projectors 23A mounted at the central portion can project the rotating image on the screen 22H in the shape of a cylinder. Accordingly, an establishment for viewing image 1W of the twenty fourth embodiment may be used in this way.

As set forth above, the advantages of the present invention are as follows:

(1) An establishment for viewing image comprises a moving object attached such that it moves due to a move device, the moving object having a plurality of seats for guest; a screen provided such that a panoramic image of the screen can be viewed from the seats of the moving object; and an image produng system projects the panoramic image on the screen so that it produce an advanced impractical experience to the spectators so that the establishment gives the spectators to gravity-acceleration, feeling of speed, and change of vision (2) It need not to depend on gravity-acceleration or feeling of high speed, and therefore, the size of the establishment can be reduced and it can be managed safely.

(3) The establishment is covered by the concave screen or the like so that it can be operated at all-weather establishment even if it is a rainy day.

(4) By changing a software, it can produce a different sight experience even if the same establisment is used, and it is easy to get the customers repeatedly.

(5) By partitioning the image by a tunnel or a partition wall, the spectors have the different experiences in order at same establishment, the establishment has various enjoyable elements.

(6) The spectators view the image while they move so that it is not required high technique for a quality of the image, the connecting portion of the image or the like because the spectators pay less attention to the details of image.

(7) It has a simple structure so that it can be constructed at low cost comparatively.

(8) The image device can mount to the conventional establishment later on, and the conventional establishment can be reconstructed.

(9) The spectators view the rotating or moving image so that they do not pay attention to the detail of image. Therefore, the image is not required an advanced technology for the aocuracy of the image and transaction of joining portion of the images respectivly or the like.

What is claimed is:

1. An establishment for viewing an image, comprising:

a movable object;

a device for imparting motion to said movable object;

seats, each for accommodating at least one guest, mountably supported on said movable object;

a screen disposed to permit viewing thereof by the guest from the seats of the movable object; and an image producing system for projecting a panoramic image onto the screen, said image producing system including at least one projector mountably located between a central position of said movable object and a peripheral position of said movable object spaced apart from the screen towards the central position, said at least one projector being non-movably secured to a stationary structure of said establishment to project onto a predetermined region of said screen, said region corresponding to at least a portion of said panoramic image.

2. An establishment for viewing an image according to claim 1, wherein the movable object includes a support structure formed in a shape of a disc, said disc being of substantially rigid construction, and said seats are disposed at an upper surface of said support structure of said movable object.

3. An establishment for viewing an image according to claim 1, wherein the screen is formed substantially in a shape of a cylinder.

4. An establishment for viewing an image according to claim 1, wherein the image producing system includes four projectors which can project a respective porion of the panoramic image on the screen.

5. An establishment for viewing an image according to claim 1, wherein said at least one projector projects said image radially outward of a mounted location thereof.

6. An establishment for viewing an image, comprising:

seats, each for accommodating a guest;

a screen disposed to permit viewing thereof by the guest from the seats; and an image producing system for projecting a panoramic rotating image on the screen, said image producing system including at least one projector mountably located between a central seated position occupiable by said guest and a peripheral seated position occupiable by said guest spaced apart from the screen towards the central position, said at least one projector being non-movably secured to a stationary structure of said establishment to project onto a predetermined region of said screen, said region corresponding to at least a portion of said panoramic rotating image.

7. An establishment for viewing an image according to claim 6, wherein the screen is formed substantially in a shape of a cylinder.

8. An establishment for viewing an image according to claim 6, wherein the image producing system includes four projectors which can project a respective portion of panoramic rotating image on the screen.

9. An establishment for viewing an image according to claim 6, wherein said at least one projector projects said image radially outward of mounted location thereof.

* * * * *